US011859890B2

(12) United States Patent
Hong et al.

(10) Patent No.: US 11,859,890 B2
(45) Date of Patent: Jan. 2, 2024

(54) REFRIGERATOR

(71) Applicant: LG Electronics Inc., Seoul (KR)

(72) Inventors: Jinil Hong, Seoul (KR); Nayoung Kim, Seoul (KR); Ayoung Choo, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/725,884

(22) Filed: Apr. 21, 2022

(65) Prior Publication Data

US 2022/0397328 A1 Dec. 15, 2022

(30) Foreign Application Priority Data

Jun. 10, 2021 (KR) ..... 10-2021-0075205

(51) Int. Cl.

| | |
|---|---|
| ***F25C 5/20*** | (2018.01) |
| ***F25D 17/06*** | (2006.01) |
| ***F25D 17/08*** | (2006.01) |

(52) U.S. Cl.

CPC ..... *F25C 5/22* (2018.01); *F25D 17/065* (2013.01); *F25D 17/08* (2013.01); *F25C 2400/10* (2013.01); *F25D 2317/061* (2013.01); *F25D 2317/062* (2013.01)

(58) Field of Classification Search

CPC ..... F25C 5/22; F25C 2400/10; F25D 17/065; F25D 17/08; F25D 2317/061; F25D 2317/062

See application file for complete search history.

(56) References Cited

U.S. PATENT DOCUMENTS

| | | | | |
|---|---|---|---|---|
| 2006/0260350 | A1 | 11/2006 | Meter et al. | |
| 2007/0084229 | A1* | 4/2007 | Han | F25D 17/065 62/340 |
| 2012/0111048 | A1 | 5/2012 | Kim et al. | |
| 2012/0174613 | A1* | 7/2012 | Park | F25C 5/22 62/320 |
| 2017/0307281 | A1* | 10/2017 | Morgan | F25C 5/185 |
| 2018/0164020 | A1* | 6/2018 | Gary | F25D 17/065 |
| 2019/0145686 | A1 | 5/2019 | Kim et al. | |

FOREIGN PATENT DOCUMENTS

| | | |
|---|---|---|
| JP | S63123967 | 8/1988 |
| KR | 100597676 | 7/2006 |
| KR | 10-2012-0069686 | 6/2012 |
| WO | WO 2022/0114761 | 6/2022 |

OTHER PUBLICATIONS

Extended Search Report in European Appln. No. 22178298.0, dated Nov. 9, 2022, 8 pages.

* cited by examiner

*Primary Examiner* — Elizabeth J Martin
(74) *Attorney, Agent, or Firm* — Fish & Richardson P.C.

(57) ABSTRACT

A refrigerator includes a cabinet defining a storage space, a door configured to open and close at least a portion of the storage space, and an ice maker assembly provided in the storage space. The ice maker assembly includes an ice maker provided forward of a cold air discharge port that is provided at a rear portion of the storage space, where the cold air discharge port is configured to deliver cold air, a front cover that covers a front side of the ice maker and that is configured to be exposed to an outside of the cabinet based on the door being opened, and a heat insulating material provided at a rear surface of the front cover and configured to at least partially block the cold air passing through the ice maker from being delivered past a front surface of the front cover.

20 Claims, 19 Drawing Sheets

REFRIGERATOR

CROSS-REFERENCE TO RELATED APPLICATIONS

The present application claims priority under 35 U.S.C. 119 and 35 U.S.C. 365 to Korean Patent Application No. 10-2021-0075205 filed on Jun. 10, 2021, which is hereby incorporated by reference in its entirety.

BACKGROUND

The present disclosure relates to a refrigerator.

In general, refrigerators are home appliances for storing foods at a low temperature in a storage chamber that is covered by a door. To this end, the refrigerator is configured to keep stored food in an optimal state by cooling the inside of the storage space using cold air generated through heat exchange with a refrigerant circulating in a refrigeration cycle.

Recently, refrigerators are gradually becoming larger and more multifunctional in accordance with the change in dietary habits and the trend of luxury products. For instance, refrigerators having various structures and convenient devices for user convenience and efficient use of internal space have been released.

In particular, recent refrigerators are provided with an automatic ice maker capable of automatically making and storing ice. In some cases, an ice maker is provided in a freezing compartment. In the refrigerator having such a structure, a cold air discharge port may be formed at the rear of the ice maker so as to ensure the ice making performance of the ice maker. However, in the case of such a structure, at least a part of the discharge port may be covered by the ice maker. As a consequence, cold air may not be effectively supplied to a space in front of the ice maker. In addition, if cold air is not circulated in the space in front of the ice maker and becomes stagnant, frost may be generated in this space. This may cause inconvenience to users and cause a deterioration in refrigeration performance.

SUMMARY

An implementation of the present disclosure aims to provide a refrigerator in which cold air may be smoothly supplied to a plurality of ice makers and a storage space provided in a freezing compartment.

An implementation of the present disclosure aims to provide a refrigerator capable of improving ice making performance of an old ice maker provided in a freezing compartment.

An implementation of the present disclosure aims to provide a refrigerator capable of making a temperature distribution uniform in a freezing compartment in a structure in which an ice maker is provided in the freezing compartment.

An implementation of the present disclosure aims to provide a refrigerator capable of preventing condensation and frost from occurring in front of an ice maker.

A refrigerator according to an implementation of the present disclosure includes a cabinet having a storage space defined therein, a door opening or closing an opened front surface of the storage space; and an ice maker assembly provided in the storage space, wherein the ice maker assembly includes an ice maker provided in front of a cold air discharge port defined in a refrigeration compartment, a front cover exposed when the door is opened and shielding the ice maker from a front, and a heat insulating material provided on a rear surface of the front cover to block cold air passing through the ice maker from being delivered to a front surface of the front cover.

The cold air discharge port may be provided at an upper end of a rear surface of the storage space.

The ice maker may shield the cold air discharge port from a front.

The ice maker assembly may include an ice maker cover shielding the ice maker from above, and a cover passage may be defined in the ice maker cover so that cold air discharged from the cold air discharge port is guided to bypass the ice maker and direct toward a front of the front cover.

The ice maker cover may include a cover body shielding an upper surface of the ice maker, and a lower surface of the cover body may be opened to define a space in which the upper surface of the ice maker is accommodated.

A sidewall extending upward to contact an upper surface of the storage space to define the cover passage between the cover body and the upper surface of the storage space may be disposed on an upper surface of the cover body.

The front cover may be provided with a cover discharge port communicating with the cover passage and opened to a front.

The cover discharge port may be defined by recessing an upper end of the front cover upward and is spaced apart from an upper surface of the storage space in a state in which the front cover is mounted.

A front discharge port which passes through a front surface of the front cover and through which cold air supplied from the cover passage is discharged may be defined below the cover discharge port.

A discharge port guide partitioning between the cover discharge port and the front discharge port may be disposed between the cover discharge port and the front discharge port.

The discharge port guide may include a first guide defining a lower end of the cover discharge port so that cold air flowing from the cover passage is guided forward, and a second guide extending downward from a front end of the first guide so that cold air flowing from the cover passage is guided below the front discharge port.

The first guide may be formed to have an inclination that decreases forward, and a rear end of the first guide may be located higher than a front end of the cover passage.

The second guide may protrude more than a front surface of the front cover, and the front discharge port may be spaced apart between a lower end of the first guide and a front surface of the front cover.

The front cover may include a front portion defining a front appearance and shielding the ice maker, and an edge portion extending rearward along a circumference of the front portion, and the heat insulating material may be made of a foam material and is inserted into an inner space of the edge portion.

A heat insulating material cutout portion may be defined at an upper end of the heat insulating material so as not to interfere with the cover discharge port and the front discharge port.

A distribution duct branching and supplying cold air discharged from the cold air discharge port to the ice maker cover and the inside of the ice maker may be provided between the cold air discharge port and the cover passage.

The ice maker may include an ice maker case including a case upper surface defining an upper surface and a case circumferential surface extending downward along a circumference of a case upper surface and defining a downwardly opened space; and an ice tray mounted inside the ice maker case and forming a plurality of cells configured to make ice.

A rear end of the case upper surface may be provided with a case inlet communicating with the cold air discharge port to allow cold air to flow into the ice maker, a front end of the case upper surface may be provided with a case outlet through which cold air flowing into the case inlet is discharged, and the plurality of cells may be disposed between the case inlet and the case outlet.

A discharge passage which communicates with the case outlet and through which cold air is discharged below the front cover may be defined between a rear surface of the front cover and a front surface of the ice maker case, and the heat insulating material may be located inside the discharge passage.

The discharge passage may have an upper end communicating with the case outlet and a lower end opened downward from a lower end of the front cover.

DETAILED DESCRIPTION

Hereinafter, detailed implementations will be described in detail with reference to the accompanying drawings. However, the scope of the present disclosure is not limited to proposed implementations of the present disclosure, and other regressive disclosures or other implementations included in the scope of the spirits of the present disclosure may be easily proposed through addition, change, deletion, and the like of other elements.

In addition, in implementations of the present disclosure, a side-by-side type (or a double-door type) refrigerator in which a pair of doors are disposed on left and right sides will be described as an example for convenience of explanation and understanding, and it is noted that the present disclosure is applicable to any refrigerators provided with a dispenser.

Figure 1:
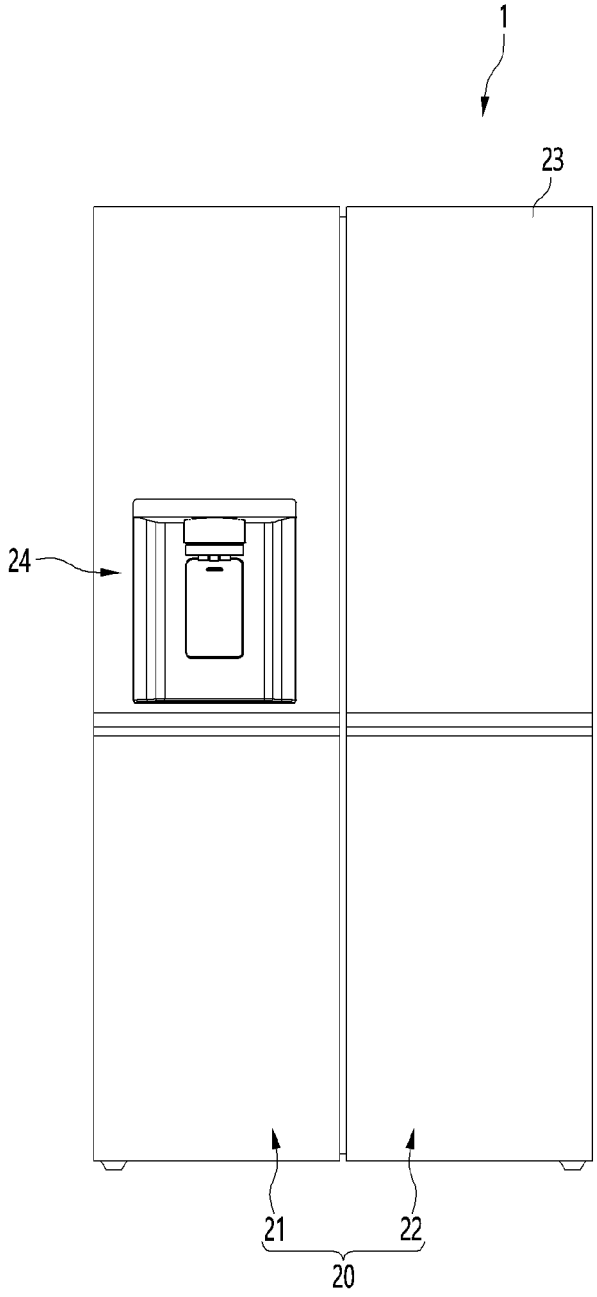
FIG. 1 is a front view of an example refrigerator according to an implementation of the present disclosure.
Figure 2:
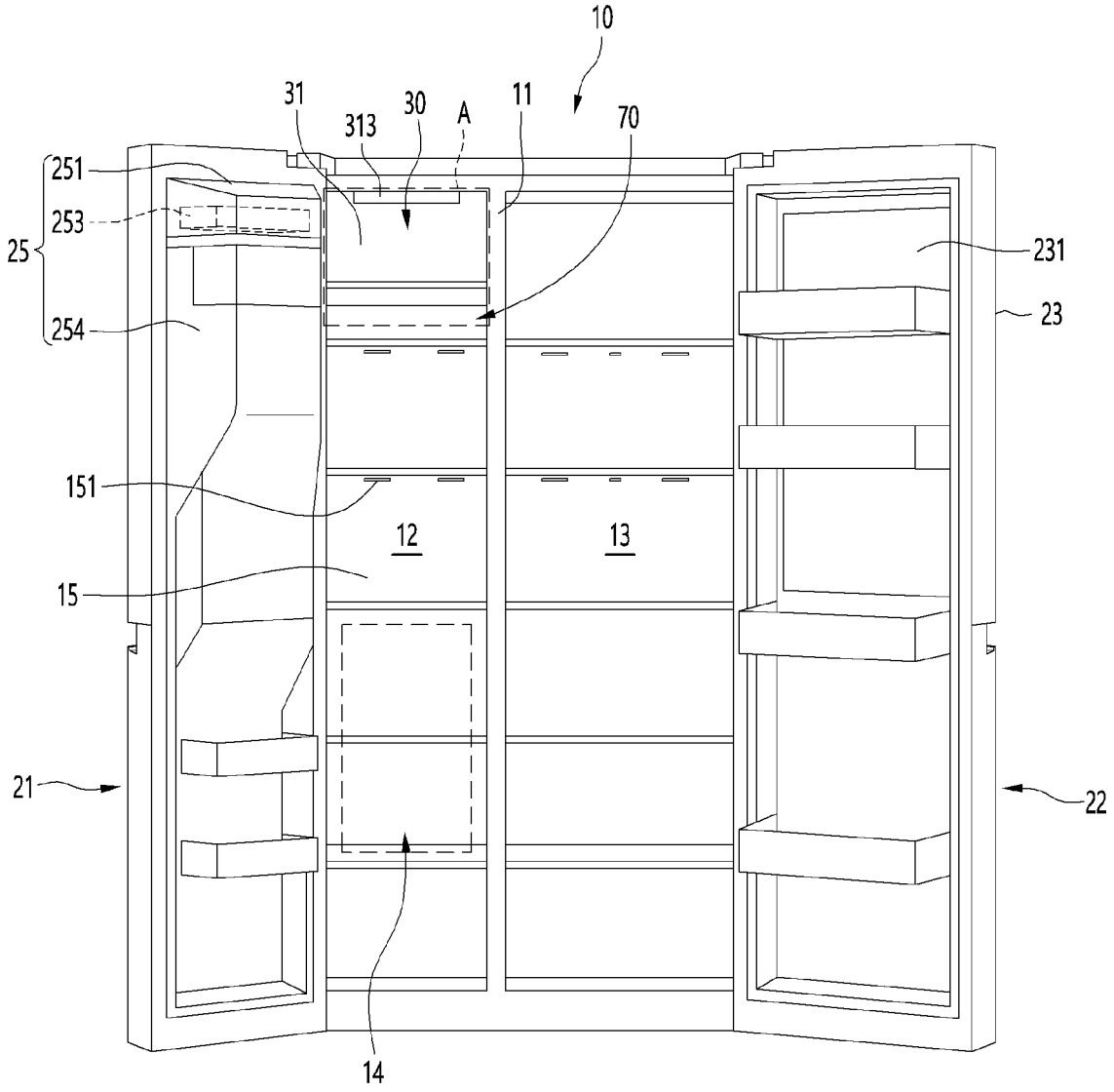
FIG. 2 is a front view illustrating an example state in which a door of the refrigerator is opened.

Prior to the description, the directions are defined below for improved clarity. In FIGS. 1 and 2, a direction toward a door with respect to a cabinet may be defined as "front" or "forward," a direction toward the cabinet with respect to the door may be defined as "rear" or "rearward," a direction toward the floor where the refrigerator is installed may be defined as "downward," and a direction away from the floor where the refrigerator is installed may be defined as "upward."

Figure 3:
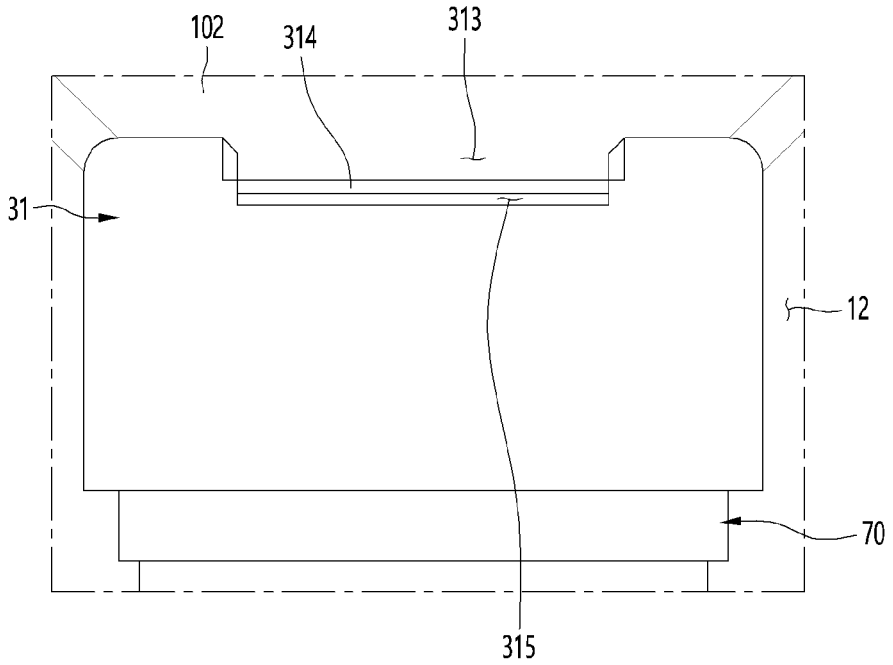
FIG. 3 is an enlarged view of a portion A in FIG. 2.
Figure 4:
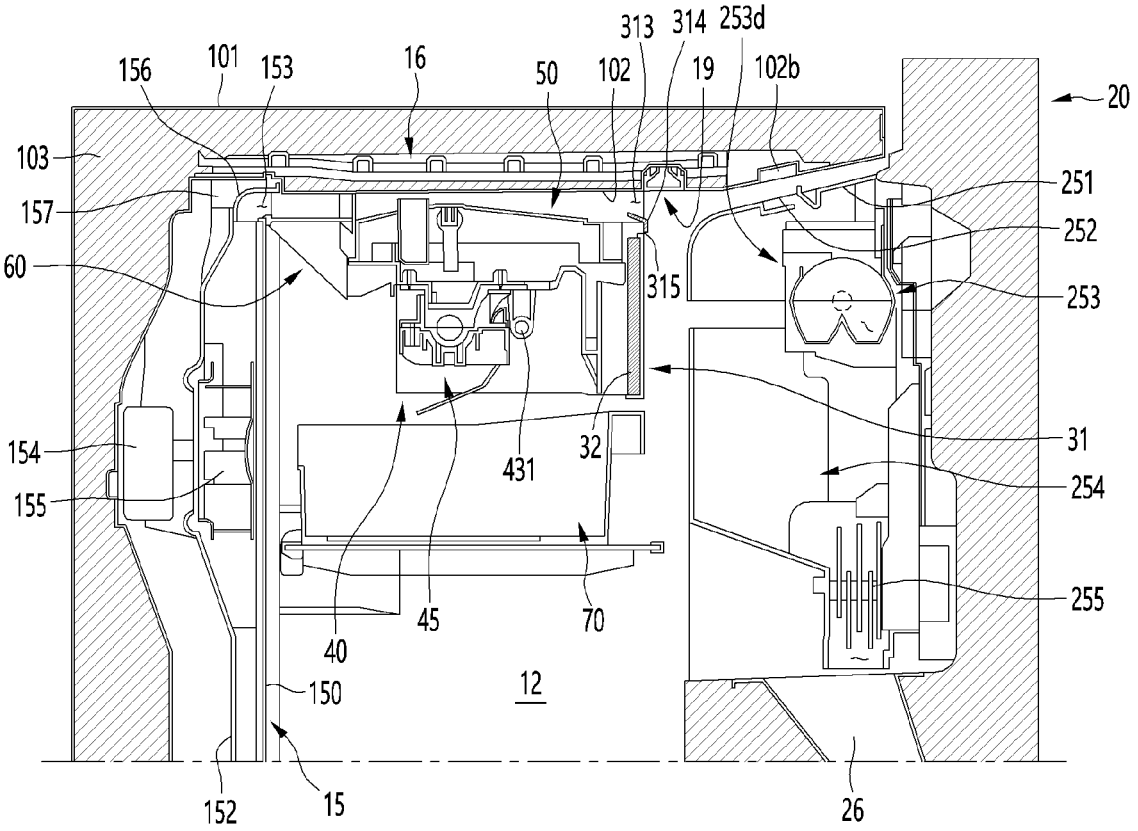
FIG. 4 is a cross-sectional view of an upper portion of a freezing compartment of the refrigerator.

FIG. 1 is a front view of a refrigerator according to an implementation of the present disclosure. Also, FIG. 2 is a front view illustrating a state in which the door of the refrigerator is opened. Also, FIG. 3 is an enlarged view of a portion A. Also, FIG. 4 is a cross-sectional view of an upper portion of a freezing compartment of the refrigerator.

As shown in the drawings, an outer appearance of a refrigerator 1 according to the implementation of the present disclosure may be defined by a cabinet 10 defining a storage space and a door 20 coupled to the cabinet 10 to open or close the storage space.

The cabinet 10 may include an outer case 101 defining an outer appearance and an inner case 102 disposed inside the outer case 101 to define the storage space. A heat insulating material 103 may be filled between the outer case 101 and the inner case 102.

A barrier 11 may be formed in the inner case 102. The barrier 11 may partition the storage space inside the cabinet 10 left and right, so that a freezing compartment 12 and a refrigerating compartment 13 are defined side by side. The inner case 102 may define inner surfaces of the freezing compartment 12 and the refrigerating compartment 13. If necessary, the inner case 102 defining the refrigerating compartment 13 and the inner case 102 defining the freezing compartment may be formed independently.

Storage members such as drawers and shelves may be disposed inside the freezing compartment 12 and the refrigerating compartment 13.

An evaporator 14 may be provided at the rear of the freezing compartment 12, and the evaporator 14 may be shielded by a grille pan 15. The grille pan 15 may define rear wall surfaces of the refrigerating compartment 13 and the freezing compartment 12. The grille pan 15 may be provided with a shroud 152 defining a passage through which cold air generated by the evaporator 14 may flow. A fan motor 154 and a blowing fan 155 are provided in the shroud 152 to allow cool air generated by the evaporator 14 to flow along the passage of the grille pan 15. A discharge port 151 through which cold air is discharged may be defined in the grille pan 15.

An ice maker assembly 30 may be provided in an uppermost space of the freezing compartment 12. The ice maker assembly 30 may include an ice maker 40 capable of making automatically supplied water into ice and separating the ice.

The ice maker assembly 30 may include a distribution duct 60 that allows cold air discharged through the grille pan 15 to be branched and guided to the inside of the ice maker 40 and above the ice maker 40. The ice maker assembly 30 may further include an ice maker cover 50 that allows cold air branched by the distribution duct 60 to pass the upper side of the ice maker 40 and direct toward the front of the ice maker assembly 30. In addition, the ice maker assembly 30 may further include a front cover 31 capable of shielding a part of the space defined at the upper end of the freezing compartment 12.

An ice bin 70 may be provided below the ice maker 40. Ice made by the ice maker 40 may be dropped and stored in the ice bin 70.

The doors 20 may be disposed on both left and right sides of the refrigerator in a side by side manner. The doors 20 may be configured to rotate to open or close the freezing compartment 12 and the refrigerating compartment 13 disposed on the left and right sides. The door 20 may define the front appearance of the refrigerator 1 in a closed state. The door 20 may include a freezing compartment door 21 for opening or closing the freezing compartment 12 and a refrigerating compartment door 22 for opening or closing the refrigerating compartment 13.

The refrigerating compartment door 22 may have an opening communicating with the accommodation space at the rear of the door, and may be further provided with a sub-door 23 opening or closing the opening. At least a part of the sub-door 23 may be provided with a see-through portion 231 through which the inside can be seen.

A door ice maker assembly 25 may be provided at the freezing compartment door 21. The door ice maker assembly 25 may include a door ice maker 253 provided on the upper rear surface of the freezing compartment door 21. The door ice maker 253 may be configured to make ice using automatically supplied water and to separate the made ice to an ice bank 254.

The door ice maker 253 may have a slim structure so as to be provided on the freezing compartment door 21, and may have a structure different from that of the ice maker 40. Therefore, ice made by the door ice maker 253 may have a different shape from spherical ice made by the ice maker 40. The door ice maker 253 may be referred to as a twist type ice maker.

The ice maker 40 and the door ice maker 253 may be disposed in the same freezing compartment. When the freezing compartment door 21 is closed, the ice maker 40 and the door ice maker 253 may be disposed at positions facing each other.

An illumination device 19 for illuminating the inside of the freezing compartment 12 may be disposed in a region between the ice maker assembly 30 and the door ice maker assembly 25.

Both the ice maker 40 and the door ice maker 253 may be located at the uppermost position inside the freezing compartment 12. Therefore, the ice maker 40 and the door ice maker 253 may fill the space at the upper end of the freezing compartment 12 of the side-by-side type refrigerator, which is narrower in the left-and-right direction, compared to other types of refrigerators. In addition, the remaining space of the freezing compartment 12 may be completely used as a space for food storage.

To this end, the ice maker assembly 30 may be formed to have a size corresponding to the width of the left and right side ends of the freezing compartment 12 by arranging the ice maker 40 in the horizontal direction. Due to the horizontal arrangement of the ice maker 40, the distance at which the ice maker assembly 30 protrudes forward may be minimized. Therefore, the arrangement space of the door ice maker assembly 25 protruding from the rear surface of the freezing compartment door 21 may be secured as much as possible. In this case, the horizontal arrangement of the ice maker 40 may mean that cells C of the ice maker 40 are continuously arranged in the horizontal direction, that is, in the left-and-right direction. In addition, the horizontal arrangement of the ice maker 40 may mean that a rotation shaft 431 of the ice maker 40 are continuously arranged in the horizontal direction, that is, in the left-and-right direction.

By arranging the ice maker 40 and the door ice maker 253 side by side in front and rear at the upper end of the inside of the freezing compartment 12, cold air discharged from the rear of the ice maker 40 may be effectively transmitted to the ice maker 40 and the door ice maker 253, and the ice making performance may be secured.

That is, the ice maker 40 may make ice by cold air supplied by the distribution duct 60. The door ice maker 253 may make ice using cold air supplied by the door duct 16 provided on the upper surface of the inner case 102.

In detail, the front cover 31 shielding the ice maker 40 may be disposed in front of the ice maker 40. The front cover 31 may define the front surface of the ice maker assembly 30, may be exposed forward when the freezing compartment door 21 is opened, and may shield the ice maker 40 so as not to be exposed forward. In this case, the front cover 31 may be in contact with the upper surface of the freezing compartment 12 and the upper ends of both left and right sides of the freezing compartment 12, and may be configured to shield the space at the upper end of the freezing compartment 12.

A cover discharge port 313 and a front discharge port 315 may be defined in the front cover 31. Therefore, cold air may be discharged through the cold air discharge port 153 at the rear of the freezing compartment 12 and discharged to the front of the front cover 31 through the ice maker 40. Cold air may be discharged into the inner space of the freezing compartment 12 and the door ice maker assembly 25 in front of the ice maker assembly 30.

The door ice maker cover 251 may be provided above the door ice maker 253. The door ice maker cover 251 has a cover inlet 252 defined at a position corresponding to a duct outlet 161 of the door duct 16, and cold air supplied through the door duct 16 is supplied to the door ice maker 253.

The ice bank 254 in which ice made by the door ice maker 253 is stored may be provided below the door ice maker 253. The ice bank 254 may be provided with a crushing device 255 for crushing the discharged ice. An ice chute 26 communicating with a dispenser 24 may be formed at the lower end of the ice bank 254.

The dispenser 24 may be provided on the front surface of the freezing compartment door 21. The dispenser 24 may be configured to take out purified water or ice from the outside while the freezing compartment door 21 is closed. The dispenser 24 may be connected to the ice bank 254 by the ice chute 26. Therefore, when the dispenser 24 is operated, the ice stored in the ice bank 254 may be taken out.

Hereinafter, the structure of the grille pan 15 will be described in more detail with reference to the drawings.

Figure 5:
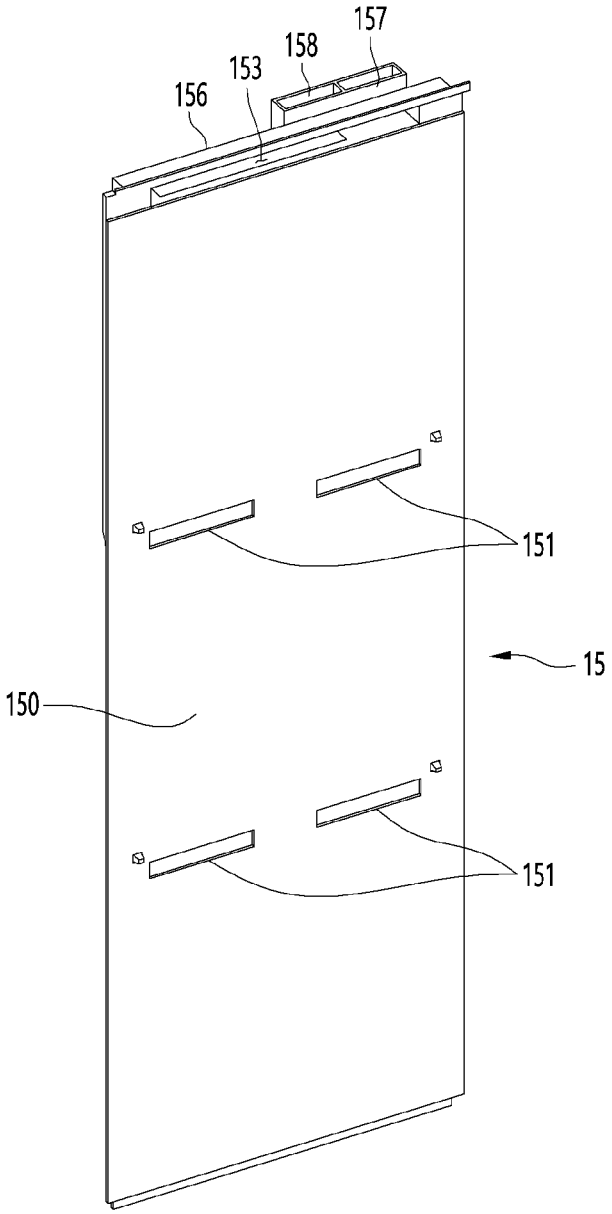
FIG. 5 is a front perspective view of an example grille pan according to an implementation of the present disclosure.
Figure 6:
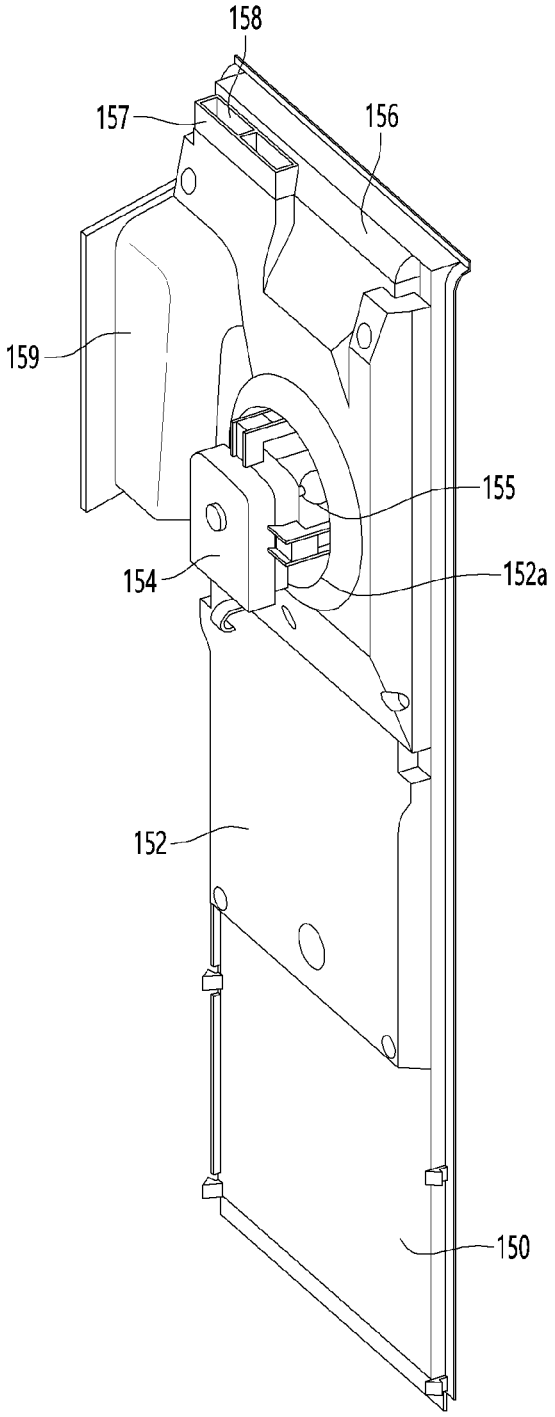
FIG. 6 is a rear perspective view of the grille pan in FIG. 5.

FIG. 5 is a perspective view of a grille pan according to an implementation of the present disclosure, when viewed from the front. Also. FIG. 6 is a perspective view of the grille pan when viewed from the rear.

As shown in the drawing, the grille pan 15 may be mounted inside the inner case 102 defining the freezing compartment 12, and may be formed to partition the space of the freezing compartment 12 back and forth.

The grille pan 15 may include a grille plate 150 defining a front surface and a shroud 152 coupled to the rear surface of the grille plate 150.

The grille plate 150 may form at least a part of the rear wall surface of the freezing compartment 12, and a discharge port 151 through which cold air is discharged may be defined in the grille plate 150. A cold air discharge port 153 through which cold air is discharged for supplying cold air to the ice maker 40 may be defined at an upper end of the grille plate 150. The cold air discharge port 153 may be formed to have a corresponding size so that the inlet of the distribution duct 60 may be inserted thereinto. The cold air discharge port 153 may be located at the upper end of the rear surface of the freezing compartment 12 in a state in which the grille pan 15 is mounted. When the distribution duct 60 is mounted, the cold air discharge port 153 may be located at a position corresponding to the distribution duct 60.

A front guide portion 156 extending upward and forward so as to be opened downward and guide cold air forward may be formed at the upper end of the grille plate 150. The cold air discharge port 153 may be defined on the front surface of the front guide portion 156. At least a part of the front guide portion 156 may be formed in a round shape.

The shroud 152 may be mounted on the rear surface of the grille plate 150, and may define a passage through which cold air generated by the evaporator 14 flows. A shroud opening 152*a* may be defined in the shroud 152, and the blowing fan 155 may be disposed inside the shroud opening 152*a*. A fan motor 154 may be provided at the rear of the shroud 152, and a rotation shaft of the fan motor 154 may be connected to the blowing fan 155. The blowing fan 155 is rotated inside the shroud 152 so that cold air generated by the evaporator 14 is introduced into the shroud 152 and then discharged.

The opened upper end of the shroud 152 may communicate with the front guide portion 156 disposed at the upper end of the grille plate 150. Therefore, cold air forcedly flowed by the blowing fan 155 may pass through the upper end of the shroud 152, may be guided forward by the front guide portion 156, and may be discharged to the cold air discharge port 153.

An upper guide portion 157 extending upward may be formed in the shroud 152. The upper guide portion 157 may be formed at a position shifted to one of the left and right sides, and may be connected to the door duct 16. An opened upper discharge port 158 may be defied at the upper end of the upper guide portion 157, and the upper discharge port 158 may be connected to an inlet at the rear end of the door duct 16. Therefore, a part of cold air forcedly flowed by the blowing fan 155 may flow into the door duct 16 along the upper guide portion 157.

A damper mounting portion 159 may be defined at one end of the shroud 152. The damper mounting portion 159 may be provided with a damper, so that a part of cold air may flow into the refrigerating compartment 13 upon air flow of the blowing fan 155.

Hereinafter, the internal structure of the freezing compartment 12 and the arrangement structure of the ice maker assembly 30 will be described in more detail with reference to the drawings.

Figure 7:
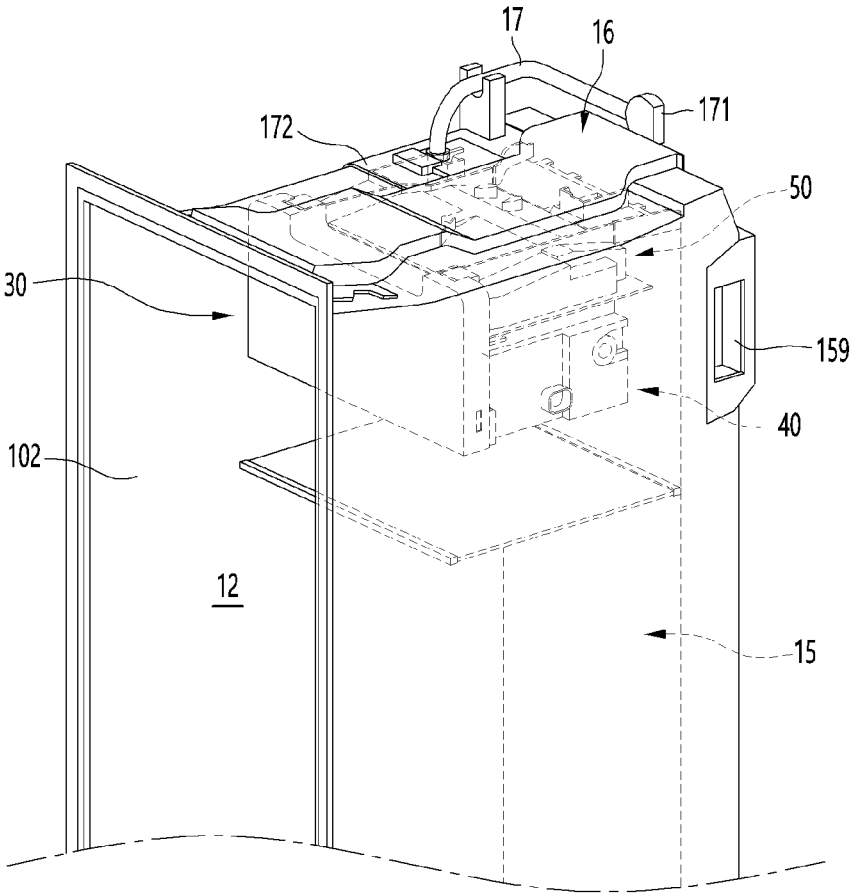
FIG. 7 is a partial perspective view illustrating an arrangement structure of an ice maker assembly and an arrangement of a door duct and a guide tube disposed in an inner case of a freezing compartment, according to an implementation of the present disclosure.
Figure 8:
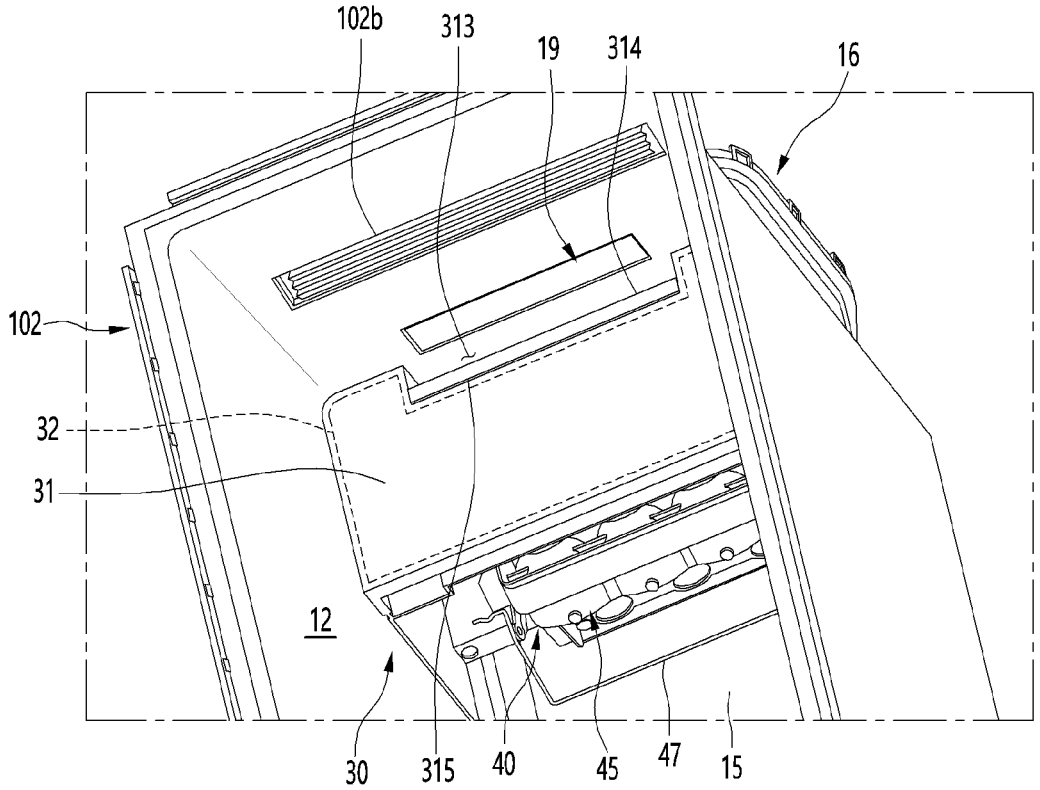
FIG. 8 is a partial perspective view of the inside of the freezing compartment in which the ice maker assembly is mounted, as viewed from below.
Figure 9:
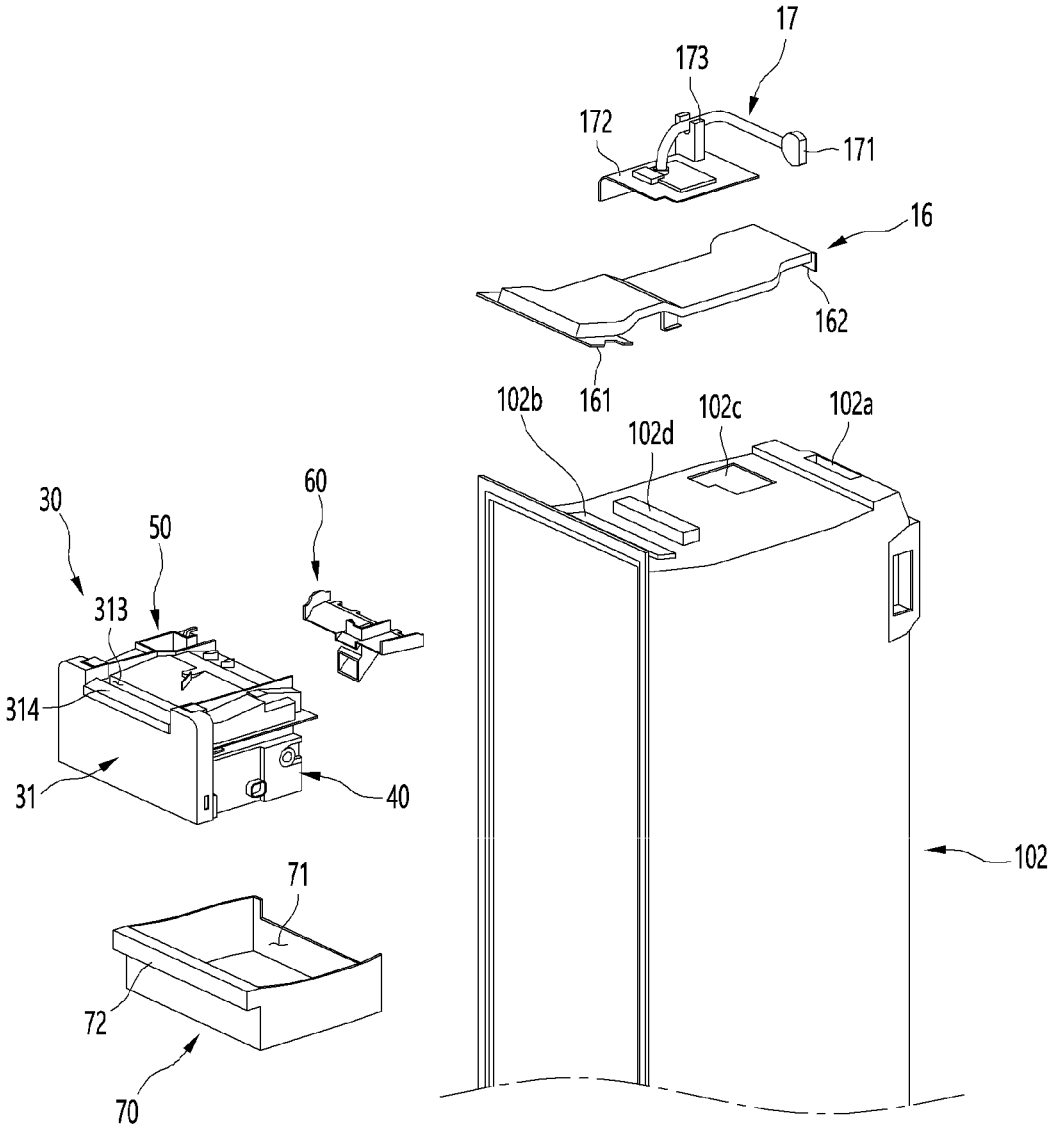
FIG. 9 is an exploded perspective view illustrating the coupling structure of the ice maker assembly, the door duct, and a guide tube.

FIG. 7 is a partial perspective view illustrating the arrangement structure of the ice maker assembly and the arrangement of the door duct and the guide tube disposed in the inner case of the freezing compartment, according to an implementation of the present disclosure. Also. FIG. 8 is a partial perspective view of the inside of the freezing compartment in which the ice maker assembly is mounted, as viewed from below. Also, FIG. 9 is an exploded perspective view illustrating the coupling structure of the ice maker assembly, the door duct, and the guide tube.

As shown in the drawings, an upper surface inlet 102*a* and an upper surface outlet 102*b* may be defined on the upper surface of the inner case 102 defining the upper surface of the freezing compartment 12. The upper surface inlet 102*a* may be opened to communicate with the space in which the evaporator 14 is disposed, and the upper surface outlet 102*b* may be opened at the front end of the upper surface of the freezing compartment 12 to face the door ice maker cover 251.

The door duct 16 may be provided on the upper surface of the inner case 102. The door duct 16 may be elongated in the front-and-rear direction, the front end and the rear end of the door duct 16 may be opened, and a passage through which cold air flows may be defined therein. The door duct 16 may be buried in the heat insulating material 103 in a state of being mounted to the inner case 102.

The duct outlet 161 and the duct inlet 162 may be defined at the front end and the rear end of the door duct 16, respectively. The duct inlet 162 may communicate with the upper discharge port 158 exposed through the upper surface inlet 102*a*, and the duct outlet 161 may communicate with the upper surface outlet 102*b*. Therefore, a part of the cold air generated by the evaporator 14 may be supplied to the door ice maker 253 through the door duct 16.

An illumination mounting portion 102*d* to which the illumination device 19 is mounted may be further defined on the upper surface of the inner case 102. The illumination mounting portion 102*d* may be located in front of the ice maker assembly 30 to illuminate the inside of the freezing compartment 12.

A water supply pipe opening 102*c* may be defined on the upper surface of the inner case 102. The water supply pipe opening 102*c* may be opened above a water supply member 49 to be described below, and a water supply pipe 174 may pass toward the ice maker 40.

A guide tube 17 may define a passage through which the water supply pipe 174 for supplying water to the ice maker 40 is guided. Both ends of the guide tube 17 may be provided with a front bracket 172 and a rear bracket 171.

The front bracket 172 may be in close contact with the upper surface of the inner case 102, and may shield the water supply pipe opening 102*c*. The end of the guide tube 17 may pass through the front bracket 172 and may be opened toward the ice maker 40. A tube support 173 protruding upward to support the guide tube 17 from below may be disposed on the front bracket 172.

The rear bracket 171 may be coupled to the rear surface of the cabinet 10. The end of the guide tube 17 may be exposed to the rear surface of the cabinet 10 through the rear bracket 171. Therefore, the water supply pipe 174 disposed along the rear surface of the cabinet 10 may be introduced into the guide tube 17 through the rear bracket 171 and directed to the ice maker 40 through the front bracket 172.

The ice maker assembly 30 may be provided on the inner upper surface of the inner case 102. The ice maker assembly 30 may be located at the upper end of the freezing compartment 12, and may be spaced apart at a position higher than an accommodation member disposed at the uppermost portion of the freezing compartment 12. The ice bin 70 in which ice made by the ice maker 40 is stored may be located below the ice maker assembly 30. The ice bin 70 may define an ice accommodation space 71 having an opened upper surface, and may be seated on the accommodation member such as a shelf. An empty handle 72 may be formed on the front surface of the ice bin 70 so that the ice bin 70 can be pulled out or lifted and moved.

A horizontal width of the ice maker assembly 30 may be formed to correspond to a horizontal width of the freezing compartment 12. Therefore, in a state in which the ice maker assembly 30 is mounted, the cold air discharge port 153 and the distribution duct 60 provided at the rear of the ice maker assembly 30 may be covered by the ice maker assembly 30. In particular, when viewed from the front of the freezing compartment, only the front cover 31 may be exposed, and all rear components may be shielded by the front cover 31.

The ice maker assembly 30 may include an ice maker 40 and the front cover 31 shielding the ice maker 40 from the front. The ice maker assembly 30 may further include an ice maker cover 50 shielding the upper surface of the ice maker 40. The ice maker assembly 30 may further include a distribution duct 60 distributing and supplying cold air to the ice maker 40 and the ice maker cover 50.

Hereinafter, the structure of the ice maker assembly 30 will be described in more detail with reference to the drawings.

Figure 10:
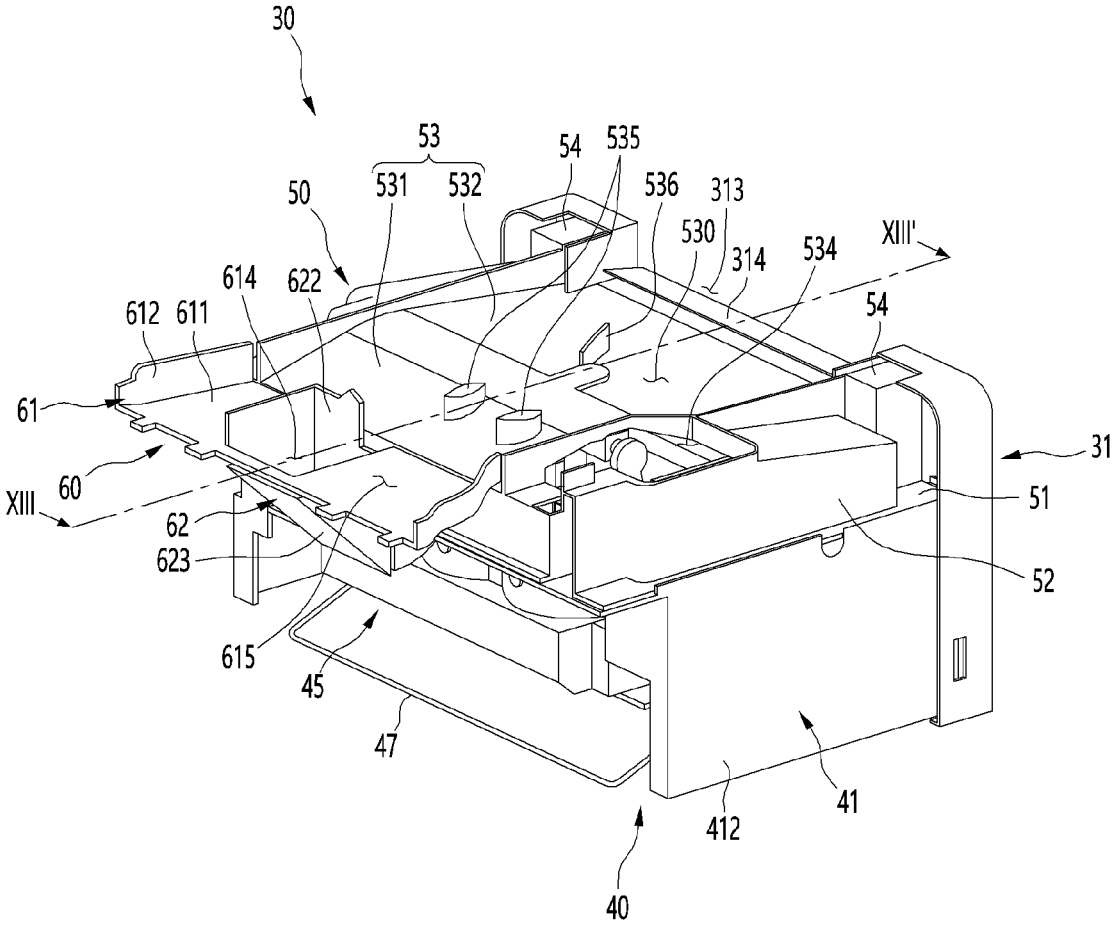
FIG. 10 is a perspective view of the ice maker assembly.
Figure 11:
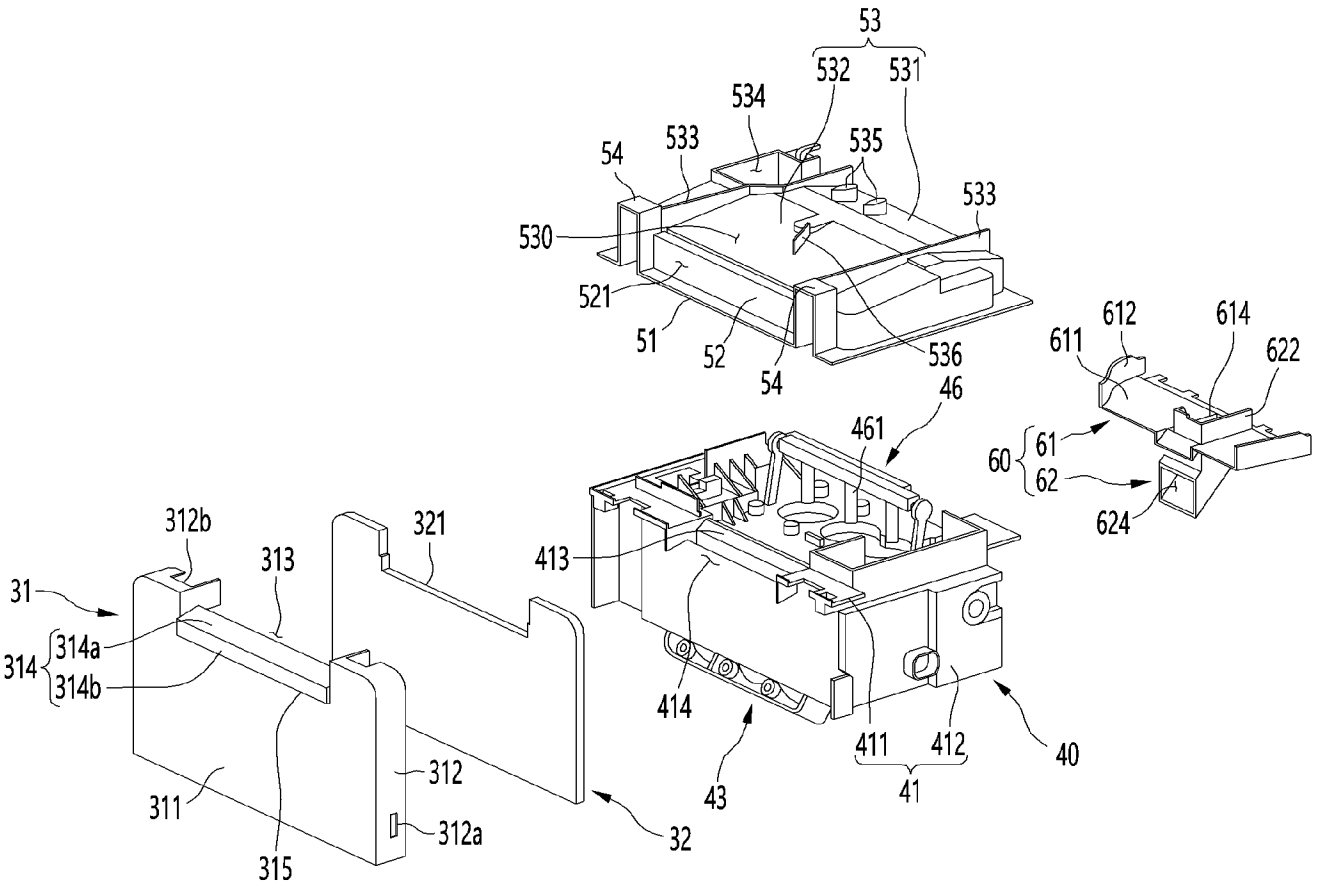
FIG. 11 is an exploded view of the ice maker assembly when viewed from the front.
Figure 12:
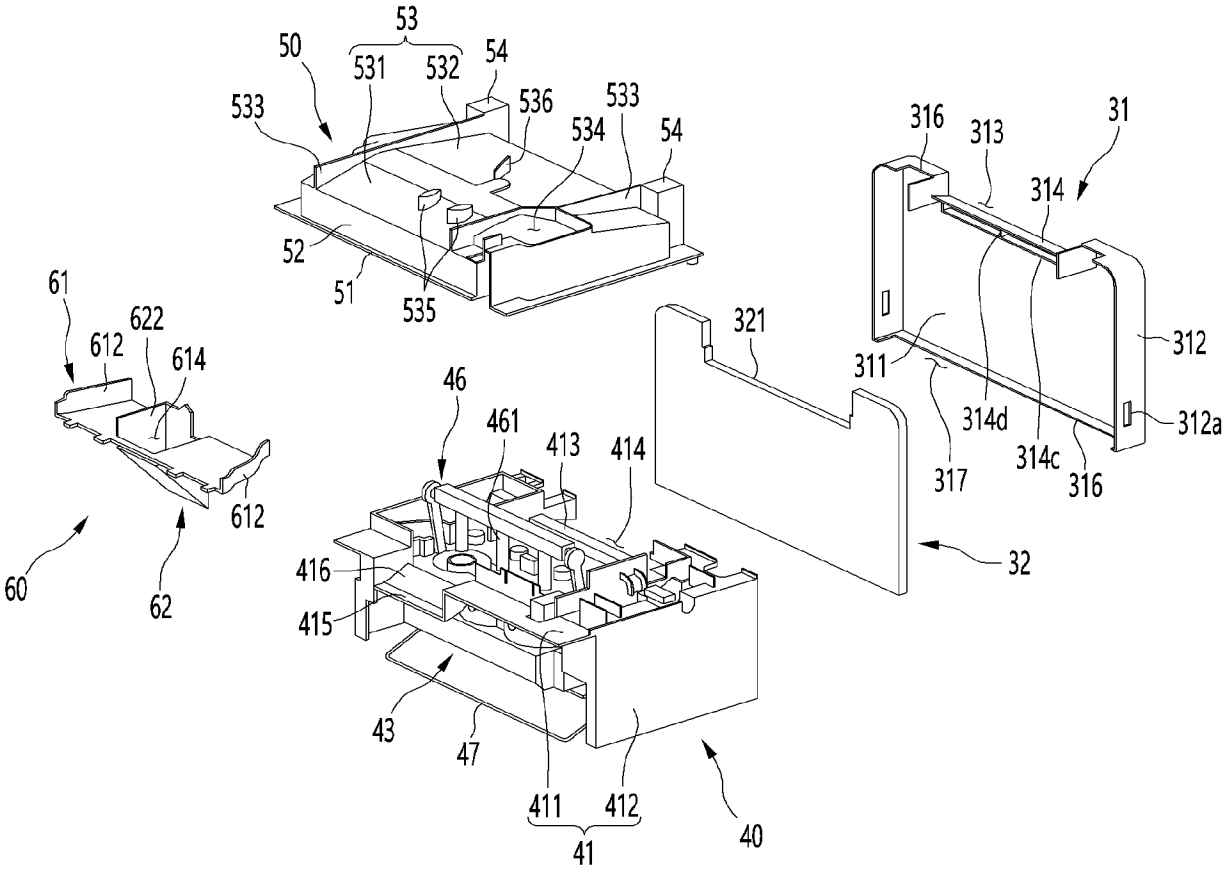
FIG. 12 is an exploded view of the ice maker assembly when viewed from the rear.
Figure 13:
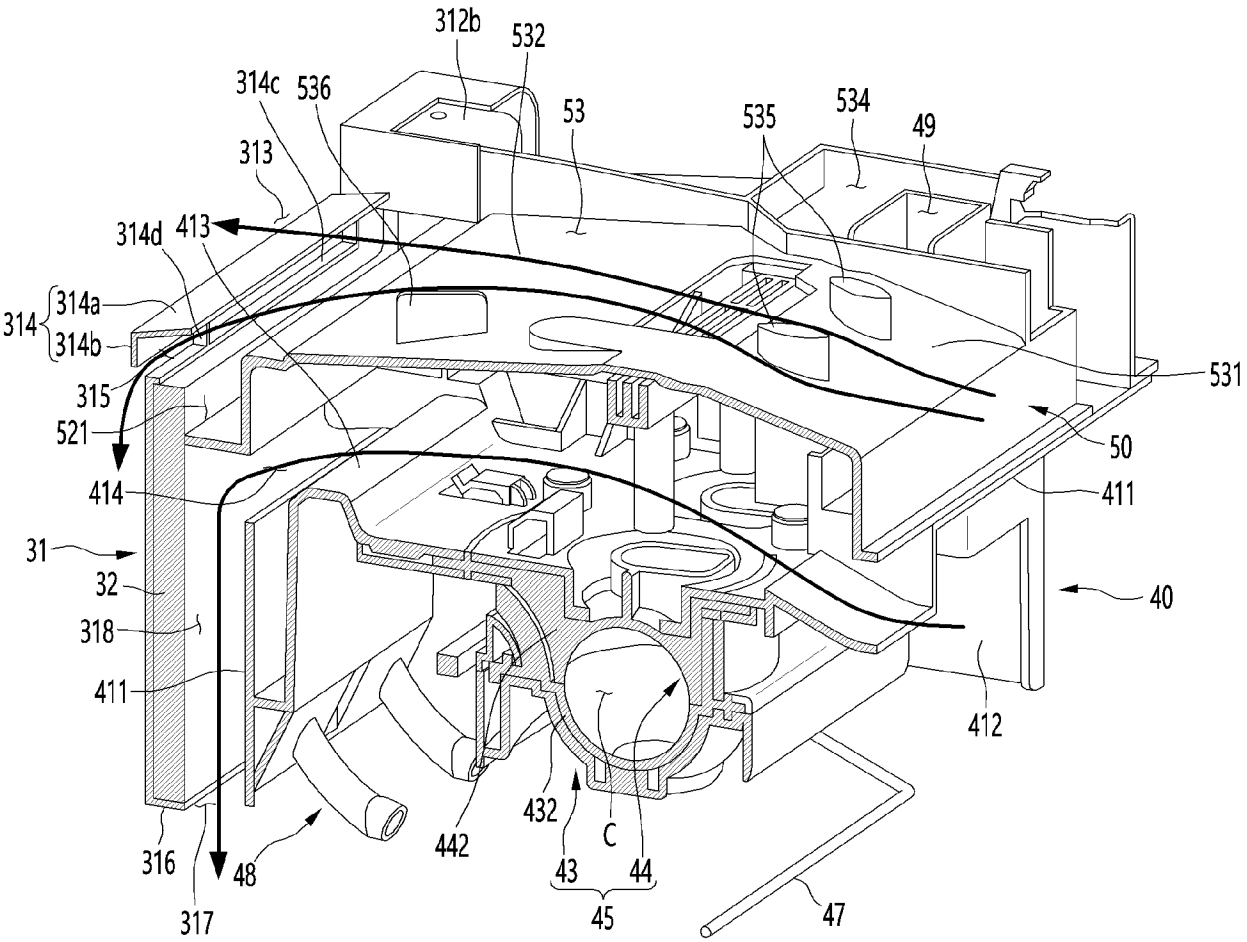
FIG. 13 is a cutaway perspective view taken along line XIII-XIII' of FIG. 10.

FIG. 10 is a perspective view of the ice maker assembly. Also, FIG. 11 is an exploded view of the ice maker assembly when viewed from the front. Also, FIG. 12 is an exploded view of the ice maker assembly when viewed from the rear. Also, FIG. 13 is a cutaway perspective view taken along line XIII-XIII' of FIG. 10.

As shown in the drawings, the ice maker assembly 30 may include the ice maker 40. The ice maker 40 receives automatically supplied water and makes spherical ice. The ice maker 40 may include an ice maker case 41 defining an outer appearance, an ice tray 45 in which water is accommodated for making ice, a driving device 42 for rotating the ice tray 45, an ejector 46 for separating the separated ice from the ice tray 45, and an ice full detection lever 47 for detecting whether the ice bin 70 is full.

The ice maker 40 may be referred to as a main body ice maker, a cabinet ice maker, or a spherical ice maker so as to be distinguished from the door ice maker 253.

The ice maker case 41 may include a case upper surface 411 defining the upper surface of the ice maker case 41, and a case circumferential surface 412 extending downward along the circumference of the case upper surface 411. The ice tray 45, the driving device 42, and the ice full detection lever 47 may be provided inside the space defined by the circumferential surface 412 of the case. The made ice may be separated from the ice tray 45 by the ejector 46, dropped downward, and stored in the ice bin 70.

A tray opening 442*a* communicating with the cell C in which ice is made inside the ice tray 45 may be exposed on the upper surface 411 of the case. The tray opening 442*a* may be provided in each of the plurality of cells C, and water supplied through the water supply pipe 174 may be introduced into the cell C through the tray opening 442*a*. As an ejecting pin 461 of the ejector 46 enters and exits above the tray opening 442*a*, the ice made in the cell C may be discharged.

A case inlet 415 through which cold air flows into the ice maker 40 and a case outlet 414 through which cold air flows out of the ice maker 40 through the case upper surface 411 may be defined at the front end and the rear end of the case upper surface 411.

An outlet guide 413 guiding cold air passing through the ice maker 40 to flow toward the case outlet 414 may be disposed at one end of the case outlet 414. The case outlet 414 may be opened forward and downward, and defines a downwardly opened passage when the front cover 31 is coupled, so that cold air passing through the upper surface of the ice maker 40 is discharged downward through the space between the front cover 31 and the front surface of the ice maker 40.

Therefore, cold air supplied to the ice maker 40 is not stagnant, and an appropriate amount of cold air for making ice may be supplied while passing through the ice maker 40. In particular, it is possible to prevent excessive supply of cold air so as to make spherical transparent ice in the ice maker 40, or to prevent deterioration of ice making quality due to stagnant cold air inside the ice maker 40.

A front cover 31 may be provided in front of the ice maker case 41. The front cover 31 defines the front surface of the ice maker assembly 30, and may shield all components disposed at the rear.

The front cover 31 may include a front portion 311 and an edge portion 312 extending rearward along the circumference of the front portion 311.

The front portion 311 may be formed in a planar shape, and may be formed to be larger than the size of the front surface of the ice maker 40. The upper end and both left and right ends of the front portion 311 come into contact with the upper surface and both right and left surfaces of the freezing compartment 12. When the freezing compartment door 21 is opened, the front surface of the front cover 31 is exposed to define the front appearance of the ice maker assembly 30, and the remaining components of the ice maker assembly 30 including the ice maker 40 and the ice maker cover 50 are not exposed to the outside.

The edge portion 312 may extend rearward from the outer end of the front portion 311, and may extend to be connected to the ice maker case 41 and/or the ice maker cover 50. The edge portion 312 may be formed along the remaining portion except for a part of the upper and lower ends of the front portion 311 so as to define an outlet through which cold air is discharged.

The front cover 31 may define a space with an opened rear surface by the edge portion 312, and a cover heat insulating material 32 may be provided in the rear space of the front cover 31. The cover heat insulating material 32 may be in close contact with the rear surface of the front portion 311, and may be formed in a shape corresponding to the shape of the front portion 311, that is, the rear space of the front cover 31. Therefore, it is possible to block cold air toward the front of the front portion 311 by the cover heat insulating material 32.

The cover heat insulating material 32 may be made of a vacuum heat insulating material or a foamed material (e.g., expanded polystyrene (EPS) foam, Styrofoam, etc.) material, and may be made of various heat insulating materials that may be molded into a sheet or plate shape. The cover heat insulating material 32 may be attached to the rear surface of the front cover 31 in a state of being pre-molded into a shape corresponding to the shape of the front portion 311. Therefore, cold air flowing along the rear of the front cover 31 may be blocked from being transmitted to the front by the cover heat insulating material 32, and may prevent condensation on the front portion 311 or the formation of frost due to condensation.

In detail, moisture introduced while opening or closing the freezing compartment door 21 may be in contact with the front cover 31 and the front surface, and when cold air supplied for ice making in the ice maker 40 is delivered to the front surface of the front cover 31, condensation or icing may occur on the front surface of the front cover 31. When the refrigerator 1 performs a defrosting operation, the internal temperature of the refrigerator rises, and condensation or icing may occur on the front cover 31 adjacent to the ice maker assembly 30 and the door ice maker assembly 25. However, when the cover heat insulating material 32 is provided on the front cover 31, cold air delivered to the front cover 31 is blocked to prevent condensation and icing on the front surface of the front cover 31.

A heat insulating material cutout portion 321 may be defined at an upper end of the cover heat insulating material 32. The heat insulating material cutout portion 321 may be formed by cutting the cover heat insulating material 32 at a position corresponding to the cover discharge port 313 and the front discharge port 315. Therefore, the heat insulating material cutout portion 321 does not interfere with the cover discharge port 313 and the front discharge port 315 to ensure smooth discharge of cold air through the cover discharge port 313 and the front discharge port 315.

The front end of the ice maker case 41 may be inserted into the opened rear surface of the front cover 31. Case coupling portions 312*a* may be disposed on both left and right sides of the edge portion 312, and may be coupled to both side surfaces of the ice maker case 41.

A mounting portion accommodation groove 312*b* in which the cover mounting portion 54 of the ice maker cover 50 is accommodated may be further defined on the upper surface of the edge portion 312. The mounting portion accommodation groove 312*b* may be formed at a position corresponding to the cover mounting portion 54 in a corresponding size. The mounting portion accommodation groove 312*b* may be defined on both sides of the cover discharge port 313 so that the cover mounting portion 54 is exposed. Therefore, a screw fastened to the ice maker case 41 passes through the cover mounting portion 54 and is fastened to the upper surface of the inner case 102 or a bracket disposed on the inner case 102 so that the ice maker assembly 30 is fixedly mounted.

A cover discharge port 313 and a front discharge port 315 may be defined at the upper portion of the front cover 31. The cover discharge port 313 may be opened so that cold air passing through the cover passage 530 of the ice maker cover 50 above the ice maker 40 is discharged forward, and the front discharge port 315 may be opened to allow cold air to flow downward along the front surface of the front cover 31 below the cover discharge port 313.

The cover discharge port 313 may be defined on the upper surface of the front cover 31. The cover discharge port 313 may be formed by recessing a part of the upper end of the front cover 31 downward. In a state in which the ice maker assembly 30 is mounted to the freezing compartment 12, the upper end of the front cover 31 is in contact with the upper surface of the freezing compartment 12, and the opened upper end of the cover discharge port 313 is in contact with the upper surface of the freezing compartment 12 to define an opening through which cold air is discharged.

The cover discharge port 313 may communicate with the cover passage 530 of the ice maker cover 50. That is, the cover discharge port 313 may be located in front of the opened front surface of the cover passage 530, so that cold air flowing along the cover passage 530 is discharged to the front of the front cover 31.

A discharge port guide 314 may be defined between the cover discharge port 313 and the front discharge port 315. The discharge port guide 314 may guide the flow of cold air to the cover discharge port 313 and the front discharge port 315. A space between the cover discharge port 313 and the front discharge port 315 may be partitioned by the discharge port guide 314.

In detail, the discharge port guide 314 may include a first guide 314*a* and a second guide 314*b*.

The first guide 314*a* may define the lower surface of the cover discharge port 313 and may extend in the front-and-rear direction. The front end of the first guide 314*a* may extend to be located more forward than the front portion 311, and the rear end of the first guide 314*a* may extend to be located more rearward than the front portion 311. For example, the rear end of the first guide 314*a* may be located further rearward than the rear surface of the cover heat insulating material 32.

The first guide 314*a* may be inclined upward so as to extend rearward. The rear end of the first guide 314*a* may be formed to be higher than the height of the front end of the cover passage 530. Therefore, cold air discharged through the cover passage 530 is branched. A part of the cold air may be discharged to the cover discharge port 313 above the first guide 314*a*, and the remaining part of the cold air may be discharged through the front discharge port 315 under the first guide 314*a*.

The second guide 314*b* may extend downward from the front end of the first guide 314*a*. In this case, the second guide 314*b* may extend in parallel with the front portion, and the second guide 314*b* may be disposed in front of the front portion 311 and spaced apart from the front portion 311. Therefore, the front discharge port 315 may be defined in a space between the lower end of the second guide 314*b* and the upper end of the front portion 311.

The discharge port guide 314 may further include a third guide 314*c* spaced apart from the first guide 314*a*. The third guide 314*c* may extend rearward from the lower end of the second guide 314*b*. The first guide 314*a* and the third guide 314*c* may be disposed in parallel with each other. Cold air guided forward by the third guide 314*c* may be discharged through the front discharge port 315.

The discharge port guide 314 may form a connection rib 314*d* connecting the first guide 314*a* to the third guide 314*c*. A plurality of connection ribs 314*d* may be formed between the first guide 314*a* and the third guide 314*c*, and may be formed perpendicular to the first guide 314*a* and the third guide 314*c*. Therefore, the connection rib 314*d* may reinforce the strength of the first guide 314*a* and the second guide 314*b* and may prevent noise caused by the flow when cold air is discharged.

A lower support portion 316 may be disposed at the lower end of the front cover 31. The lower support portion 316 may extend rearward along the lower end of the front portion 311, and may support the cover heat insulating material 32 from below. The rear end of the lower support portion 316 may be spaced apart from the front surface of the ice maker. Therefore, a lower discharge port 317 may be defined between the lower support portion 316 and the front surface of the ice maker 40.

In detail, when the front cover 31 to which the cover heat insulating material 32 is mounted is disposed in front of the ice maker 40, at least a part thereof may be spaced apart between the cover heat insulating material 32 and the front surface of the ice maker 40 to define a lower discharge passage 318. Therefore, cold air passing through the upper surface of the ice maker 40 may flow into the lower discharge passage 318 through the case outlet 414, and may be discharged through the lower discharge port 317 via the lower discharge passage 318. That is, cold air passing through the upper surface of the ice maker 40 may be discharged downward between the front cover 31 and the ice maker 40. In this case, cold air is insulated by the cover heat insulating material 32 to prevent the cold air from being delivered to the front cover 31.

The ice maker cover 50 may be provided on the upper surface of the ice maker 40 to shield the upper surface of the ice maker 40, and may define a passage of cold air that passes above the ice maker 40 and is bypassed to the front of the freezing compartment 12.

In detail, the ice maker cover 50 may shield the ice maker 40 from above, and may further define a cover passage 530, which is separated from the inside of the ice maker 40, above the ice maker 40. Therefore, cold air supplied by the distribution duct 60 may be guided by the ice maker cover 50 without passing through the ice maker 40, and may be supplied toward the front of the ice maker assembly 30, that is, toward the front space of the freezing compartment 12 and the freezing compartment door 21.

The ice maker cover 50 may include a cover body 52 having an opened lower surface and a cover edge 51 formed along the circumference of the cover body 52.

The cover edge 51 may protrude outward from the lower end of the cover body 52, and may be in contact with the circumference of the upper surface of the ice maker case 41. When the cover edge 51 is coupled to the ice maker case 41, a space 500 accommodating cold air introduced through the ice making guide portion 62 may be defined above the case upper surface 411. A recessed space is provided so that components above the ice maker 40, including the ejector 46, do not interfere.

A cover mounting portion 54 may be defined at the front end of the cover edge 51. The cover mounting portion 54 may pass through the mounting portion accommodation groove 312*b* to be in contact with the upper surface of the freezing compartment 12, and may be fixedly mounted on the upper surface of the freezing compartment 12 by a screw. Therefore, the cover mounting portion 54 may be fixedly mounted on the upper surface of the freezing compartment 12 in a state in which the front cover 31 and the ice maker cover 50 are coupled to the ice maker case 41.

A guide surface 53 for guiding the flow of cold air may be defined on the upper surface of the cover body 52. Sidewalls 533 may protrude upward on both left and right sides of the guide surface 53. In a state in which the ice maker cover 50 is mounted, a cover passage 530 through which cold air flows may be defined by the inner case 102, the sidewall 533, and the guide surface 53.

The guide surface 53 may include a front guide surface 532 that rises from the front end of the upper surface of the cover body 52 toward the rear, and a rear guide surface 531 that rises from the rear end of the upper surface of the cover body 52 toward the front. Cold air supplied through the cooling guide portion 61 may sequentially pass through the rear guide surface 531 and the front guide surface 532 and may be discharged forward through the cover discharge port 313 and the front discharge port 315.

Discharge guides 535 and 536 guiding the flow direction of cold air passing through the cover passage 530 may be disposed on the guide surface 53, and cold air passing through the cover passage 530 may flow with directionality. Due to the rear discharge guide 535 and the front discharge guide 536, the flow amount of cold air passing through the cover passage 530 may increase in one direction among the left and right sides. For example, a position with a larger flow amount of cold air may be a position close to the left and right sidewalls of the refrigerator 1, and it is possible to prevent the growth of condensation or frost by preventing stagnant air at positions adjacent to the left and right sidewalls of the refrigerator 1.

A front guide portion 521 may be disposed at the front end of the front guide portion 521. The front guide portion 521 may be recessed downward from the front end of the cover body 52. The front guide portion 521 may be recessed further downward than the cover discharge port 313 and the front discharge port 315.

Therefore, cold air discharged forward through the guide surface 53 may be partially introduced forward and may be discharged through the cover discharge port 313 along the first guide 314*a*. A part of cold air passing through the guide surface 53 may be branched by the first guide 314*a*, may be introduced into the front guide portion 521, and may be discharged through the front discharge port 315 communicating with the front guide portion 521. The front discharge port 315 may be opened downward, and thus cold air discharged through the front discharge port 315 may be discharged in front of the front cover 31, that is, in front of the front portion 311.

A water supply port 534 may be defined on the upper surface of the ice maker cover 50. The water supply port 534 is a portion through which a water supply pipe 174 extending through the inner case 102 passes, and may be opened at a position corresponding to a water supply member 49 provided in the ice maker 40. The water supply port 534 may be defined on a portion outside the cover passage 530, that is, on the outside of the sidewall 533.

A distribution duct 60 may be provided at the rear of the ice maker 40 so that cold air discharged into the freezing compartment 12 is branched and supplied to the ice maker 40 and the ice maker cover 50.

The distribution duct 60 may include a cooling guide portion 61 and an ice making guide portion 62. The cooling guide portion 61 may define a cooling passage 615 connected to the ice maker cover 50. The ice making guide portion 62 may be located below the cooling guide portion 61, and may define an ice making passage 624 connected to the inside of the ice maker case 41.

In detail, the cooling guide portion 61 may include a guide portion base 611 and a guide portion side 612. The guide portion base 611 may define the bottom surface of the cooling guide portion 61, and may be formed in a plate shape. The rear end of the guide portion base 611 may correspond to the width of the cold air discharge port 153, and the front end of the guide portion base 611 may be formed to have a width corresponding to the inlet of the cover passage 530.

The guide portion side 612 may extend upward from both left and right ends of the guide portion base 611. The guide portion side 612 may extend to contact the upper surface of the inner case 102, and the cooling passage 615 may be defined between the inner case 102 and the guide portion base 611.

A base opening 614 may be defined at the center of the guide portion base 611. The base opening 614 may communicate with the ice making guide portion 62, and may serve as the inlet of the ice making passage 624.

A vertical extension portion 622 extending upwardly may be defined along the circumference of the base opening 614. The vertical extension portion 622 guides cold air flowing into the cooling guide portion 61 toward the ice making guide portion 62, and may be defined along the front surface and one side surface of the base opening 614.

The ice making guide portion 62 may define an ice making passage 624 communicating with the base opening 614 therein. The ice making guide portion 62 may communicate with the base opening 614 and extend downward from the base opening 614, and may extend up to the case inlet 415.

Hereinafter, the structure of the ice maker 40 and the flow of cold air in the ice maker 40 will be described in more detail.

Figure 14:
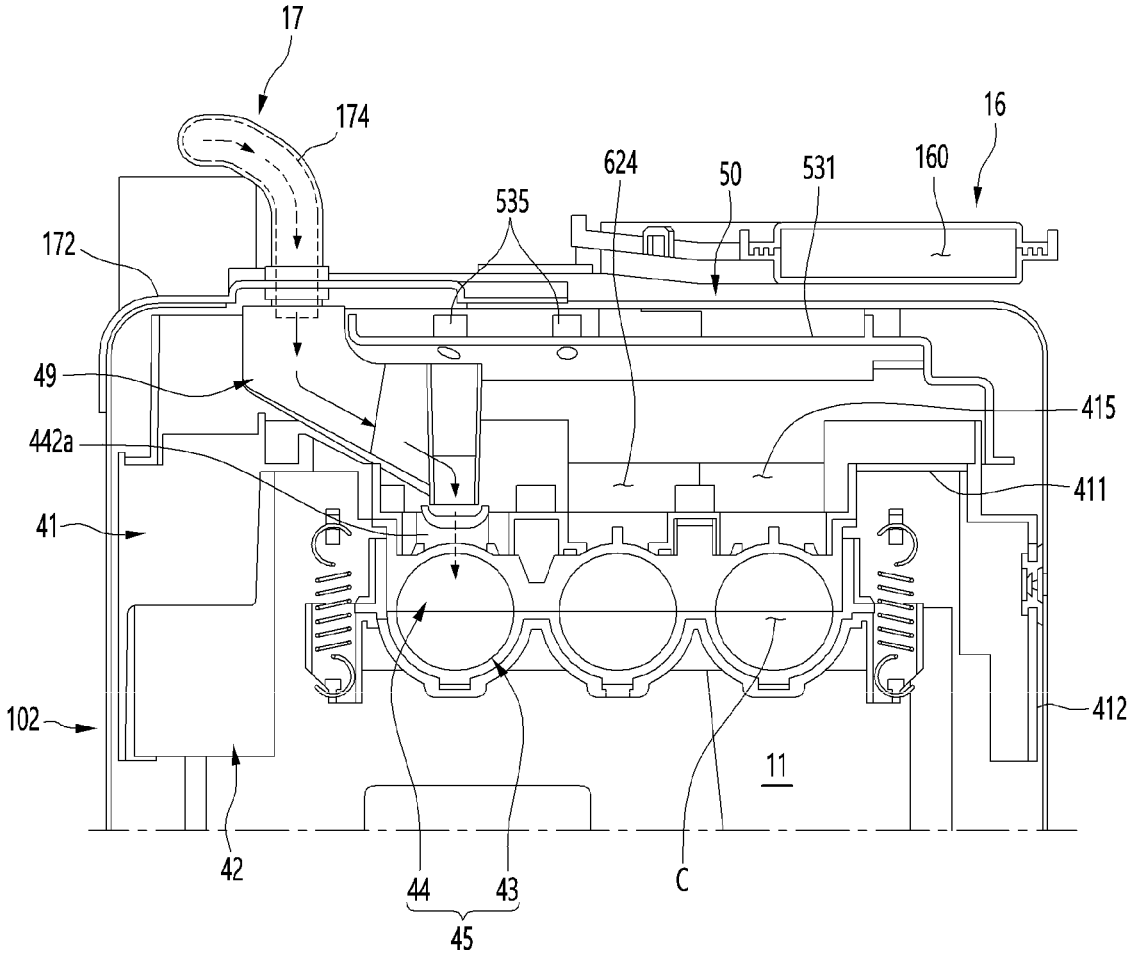
FIG. 14 is a cross-sectional view illustrating a structure for supplying water to the ice maker.
Figure 15:
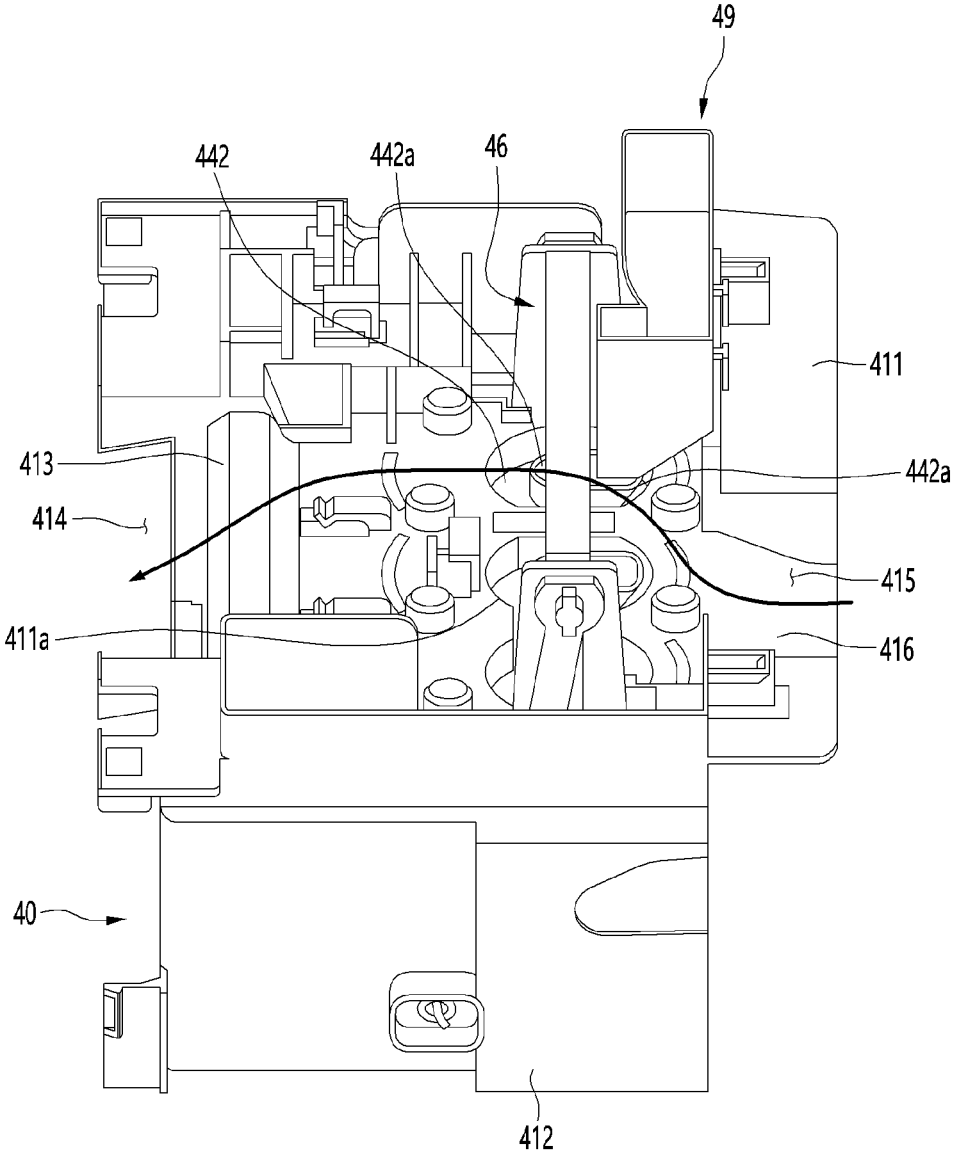
FIG. 15 is a perspective view of the ice maker when viewed from above.

FIG. 14 is a cross-sectional view illustrating a structure for supplying water to the ice maker. Also, FIG. 15 is a perspective view of the ice maker when viewed from above.

As shown in the drawings, the ice maker 40 may include an ice maker case 41 and an ice tray 45 provided inside the ice maker case 41.

The ice tray 45 may include a plurality of cells C in which water is accommodated and ice can be made. For example, the cell C may be formed in a spherical shape, and thus the ice maker 40 may be configured to make spherical ice.

The ice tray 45 may include an upper tray 44 and a lower tray 43. A plurality of cells C inside the ice tray 45 may be continuously disposed. In this case, the cells C may be disposed horizontally or vertically according to the arrangement direction of the ice tray 45. For example, as shown in FIG. 14, the plurality of the cells C may be continuously disposed in the horizontal direction, and the ice tray 45 may be disposed in the horizontal direction (left-and-right direction). Of course, the ice tray 45 may be disposed in the front-and-rear direction according to the size and arrangement of the space in which the ice maker assembly 30 is disposed.

The upper tray 44 may be fixedly mounted on the upper surface 411 of the case, and at least a part of the case upper surface 411 may be exposed. The upper tray 44 may be provided with an upper mold 442 defining the upper portion of the cell C therein, and the upper mold 442 may be made of a silicone material. A tray opening 442*a* opened to communicate with the cell C may be defined at the upper end of the upper mold 442. The ejecting pin 461 may enter and exit through the tray opening 442*a* to separate the made ice, and water may be supplied by the water supply member 49.

The water supply member 49 may be provided at a position corresponding to the cell C formed at one end of the plurality of cells C continuously disposed in the horizontal direction. Therefore, water supplied through the water supply member 49 may be introduced through one cell C, and may sequentially fills the plurality of cells C continuously disposed in the horizontal direction.

In particular, the water supply member 49 may extend to protrude further laterally than the ice tray 45, and the water supply member 49 may be positioned at a position corresponding to the end of the water supply pipe 174 located on one side of the upper surface of the inner case 102. The bottom surface of the water supply member 49 is inclined so that water is smoothly supplied to the tray opening of the upper end of the cell C.

The lower tray 43 may be provided below the upper tray 44, and may be rotatably mounted by a driving device 42 including a combination of a motor and a gear. A lower mold 432 defining the lower portion of the cell C may be disposed inside the lower tray 43. When the lower tray 43 and the upper tray 44 are coupled to each other and closed, the upper mold 442 and the lower mold 432 contact each other to form the spherical cell C and ice can be made.

A driving device 42 may be provided on one side of the ice maker case 41, and the driving device 42 may be connected to the rotation shaft 431 of the lower tray 43 to rotate the lower tray 43. An ice full detection lever 47 capable of detecting whether the inside of the ice bin 70 is full may be connected to the driving device 42. The ice full detection lever 47 may be operated when the driving device 42 is driven, and may be linked with the operation of the lower tray 43.

A lower ejector 48 may be provided on the rear surface of the ice maker case 41. The lower ejector 48 may be located on the trajectory of the lower tray 43 and may protrude forward. Therefore, when the lower tray 43 rotates after ice is made in the ice tray 45, the lower tray 43 may press the lower mold 432 to separate the ice from the lower tray 43.

The ice tray 45 may be accommodated inside the ice maker case 41, and ice may be made inside the cell C by cold air supplied into the ice maker 40.

To this end, the ice making guide portion of the distribution duct 60 may communicate with a space 500 defined by the coupling of the ice maker case 41 and the ice maker cover 50, and cold air introduced through the ice making guide portion 62 may cause ice making while passing through the ice maker 40.

In detail, a downwardly recessed case outlet 414 may be defined at the front end of the case upper surface 411. An outlet guide 413 that is lowered as it extends forward may be disposed at the rear end of the case outlet 414. Therefore, cold air passing through the case upper surface may be guided toward the case outlet 141 by the outlet guide 413.

A downwardly recessed case inlet 415 may be defined at the rear end of the case upper surface 411. A rear guide 416 that rises toward the front may be disposed on the lower surface of the case inlet 415. The case inlet 415 may be connected to the distribution duct 60 to serve as an inlet through which cold air is introduced toward the ice maker 40.

Therefore, cold air flowing into the case inlet 415 may flow forward while being directed upward through the rear guide 416, may flow forward while being directed downward through the outlet guide 413, and may be discharged to the case outlet 414. That is, cold air supplied to pass through the case upper surface 411 passes through the upper position separated from the case upper surface 411. Therefore, it is possible to ensure smooth flow of cold air and minimize interference with components protruding upward from the case upper surface 411. In addition, cold air is not intensively supplied to the ice tray 45 on which the cell C is formed. Therefore, transparent ice can be made by slowing down the freezing speed of the ice made inside the cell C.

Of course, a part of cold air flowing to the case upper surface 411 may flow into the ice maker case 41 through a plurality of openings defined on the case upper surface 411, such as the tray opening 442*a* and the opening through which the ejector 46 passes, and may cool the ice tray 45 located inside the ice maker case 41 as a whole.

Cold air guided above the ice maker cover 50 through the cooling guide portion 61 of the distribution duct 60 may be discharged into the space in front of the ice maker assembly 30 through the ice maker cover 50, without flowing into the ice maker 40.

Hereinafter, the flow of cold air in the freezing compartment 12 of the refrigerator 1 having the above structure will be described with reference to the drawings.

Figure 16:
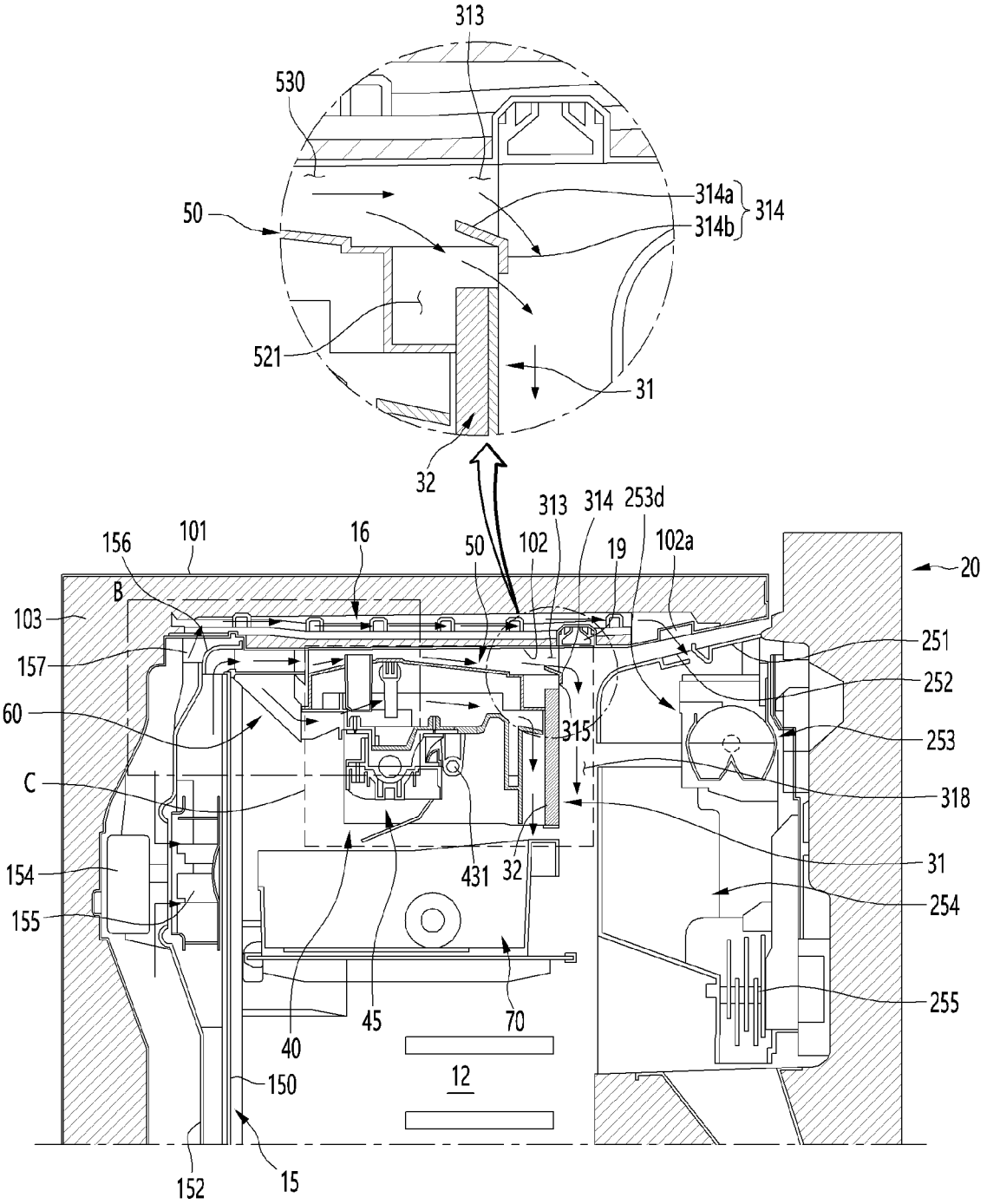
FIG. 16 is a view illustrating an example flow of cold air in the freezing compartment.
Figure 17:
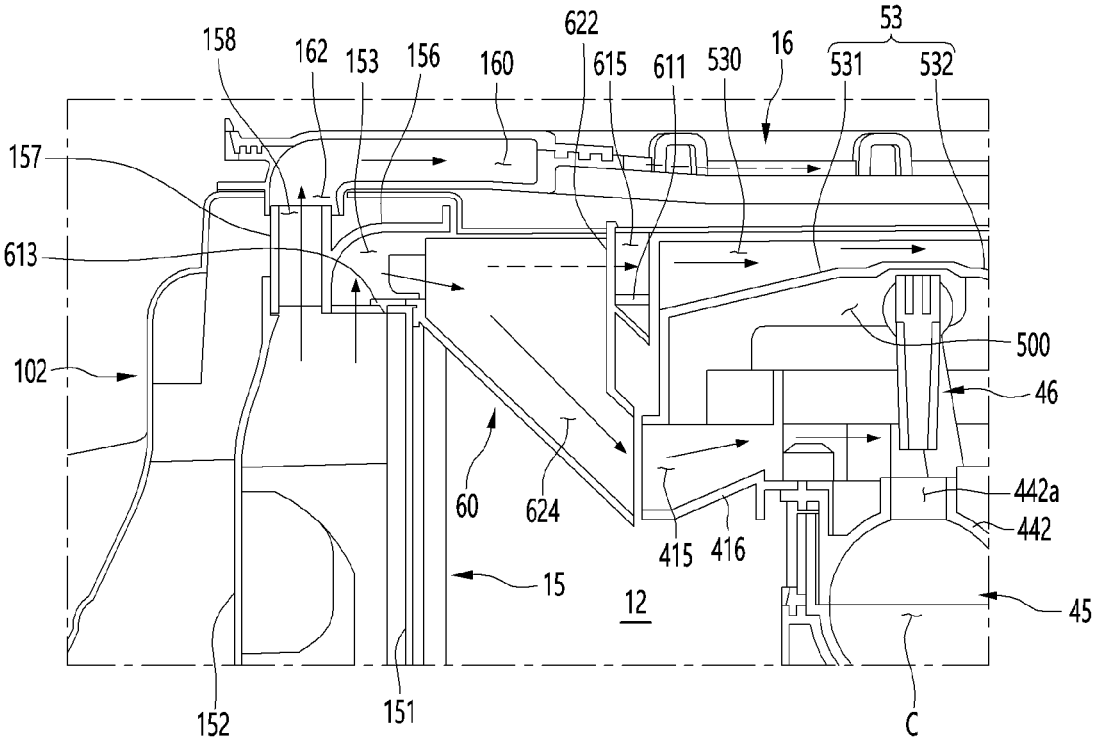
FIG. 17 is an enlarged view of a portion B of FIG. 16.
Figure 18:
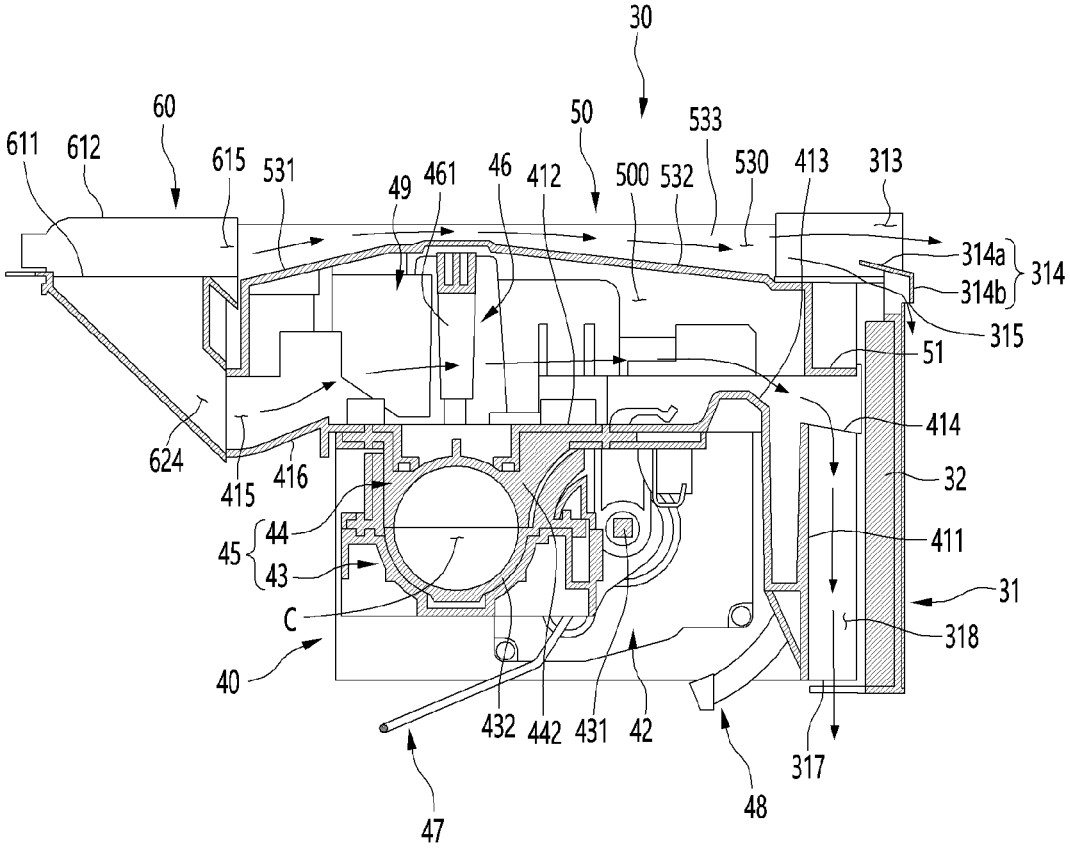
FIG. 18 is an enlarged view of a portion C of FIG. 16.
Figure 19:
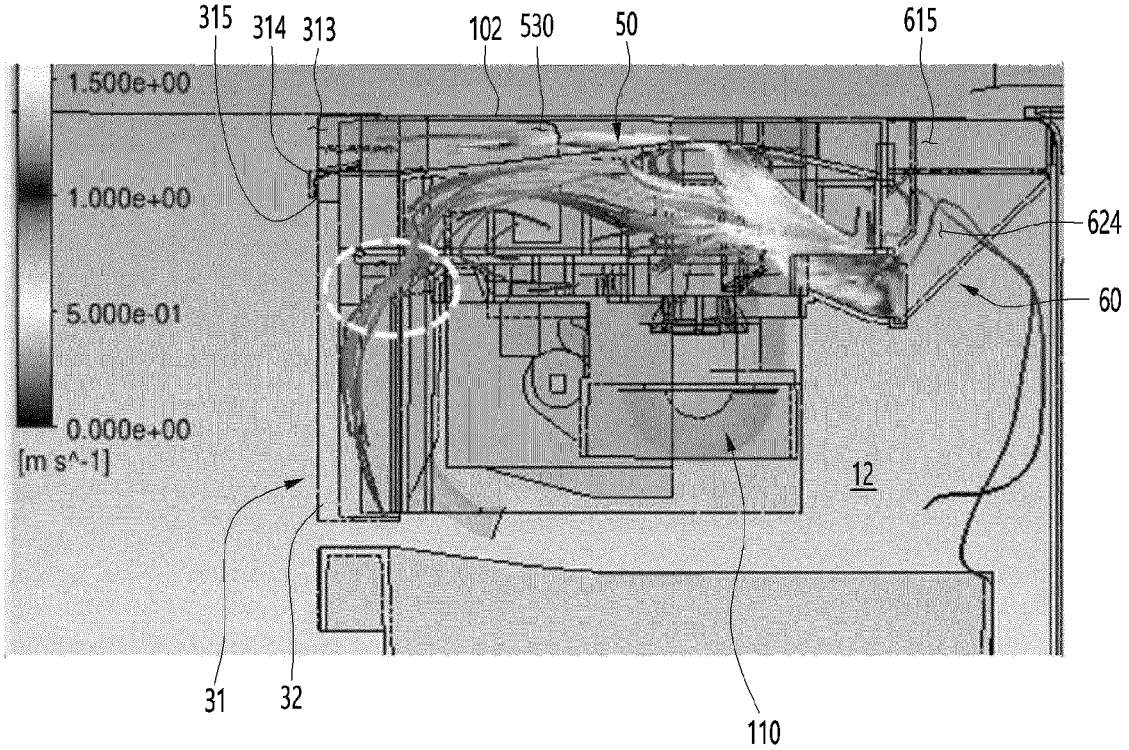
FIG. 19 is a view illustrating example simulation results of a cold air flow state inside the ice maker.

FIG. 16 is a view illustrating the flow of cold air in the freezing compartment. Also, FIG. 17 is an enlarged view of a portion B of FIG. 16. Also, FIG. 18 is an enlarged view of a portion C of FIG. 16. Also, FIG. 19 is a view illustrating simulation results showing a cold air flow state inside the ice maker.

As shown in the drawings, cold air generated in the evaporator 14 by the rotation of the blowing fan 155 may flow upward through the shroud 152. Cold air flowing along the shroud 152 may be discharged into the freezing compartment 12 through the cold air discharge port 153 of the grille pan 15 and cool the freezing compartment 12.

A part of cold air forcibly flowed by the blowing fan 155 may be introduced into the door duct 16 and the distribution duct 60 from the upper end of the grille pan 15.

In detail, cold air discharged from the upper discharge port 158 along the upper end of the grille pan 15, that is, the upper guide portion 157, may flow into the door duct 16 through the duct inlet 162 of the door duct 16, may flow along the door duct passage 160 inside the door duct 16, and may be discharged toward the door ice maker cover 251 through the duct outlet 161. Cold air discharged from the door duct 16 may flow into the door ice maker 253 through the cover inlet 252 of the door ice maker cover 251, and may allow the door ice maker 253 to perform ice making.

Cold air discharged through the cold air discharge port 153 along the upper end of the grille pan 15, that is, the front guide portion 156, may flow into the distribution duct 60, and may be branched in the distribution duct 60 and supplied to the inside of the ice maker 40 and the outside of the ice maker 40.

Cold air discharged from the cold air discharge port 153 may flow into the distribution duct 60. In this case, a part of cold air flowing into the distribution duct 60 may be branched and supplied into the cooling guide portion 61 and the ice making guide portion 62.

A part of cold air flowing into the distribution duct 60 may flow into the ice maker 40 through the ice making passage 624 of the ice making guide portion 62.

Cold air flowing into the case upper surface 411 through the case inlet 415 may be supplied to the space 500 shielded by the ice maker cover 50, and may be supplied toward the ice tray 45 through the openings of the case upper surface 411. Cold air moving forward through the case upper surface 411 is directed toward the case outlet 414 by the outlet guide 413 at the front end of the ice maker case 41. Cold air may pass through the case outlet 414 and move downward through the lower discharge passage 318 between the front cover 31 and the ice maker case 41, and may be discharged into the freezing compartment 12 through the lower discharge port 317.

In this case, as shown in FIG. 19, cold air passing through the lower discharge passage 318 is not transmitted to the front of the front cover 31 by the cover heat insulating material 32, and the front surface of the front cover 31 may be in a heat insulating state. Therefore, even when cold air flows through the lower discharge passage 318, the front surface of the front cover 31 is prevented from being cooled and condensation may be prevented from occurring.

The remaining cold air except for cold air branched into the ice making guide portion 62 among cold air flowing into the cooling guide portion 61 may flow into the cover passage 530 above the ice maker cover 50 through the cooling passage 615.

Cold air flowing into the cover passage 530 may sequentially pass through the front guide surface 532 and the rear guide surface 531, and may be discharged into the space of the freezing compartment 12 in front of the ice maker assembly 30 through the cover discharge port 313 and the front discharge port 315.

In detail, cold air discharged through the cover passage 530 is branched by the discharge port guide 314. A part of the cold air is introduced into the cover discharge port 313 by the guidance of the first guide 314*a* and is discharged forward through the cover discharge port 313. Cold air discharged forward may be directed toward the door ice maker assembly 25, or may cool the inside of the space in the freezing compartment 12 in front of the ice maker assembly 30.

In detail, cold air discharged through the cover passage 530 is branched by the discharge port guide 314. The remaining part of the cold air may flow below the first guide 314*a* and may be discharged through the front discharge port 315. The front discharge port 315 may be opened downward, and a part of cold air discharged through the front discharge port 315 may supply cold air to the front of the front cover 31.

Therefore, even when condensation or frost is partially formed on the front surface of the front cover 31, the condensation or frost may be removed by cold air passing through the front surface of the front cover 31. That is, even when condensation or frost is generated on the surface of the front cover 31 due to the opening of the freezing compartment door 21 or the defrosting operation, the condensation or frost generated on the front cover 31 may be removed by the cold air discharged downward through the front discharge port 315.

As such, cold air discharged into the freezing compartment 12 may be supplied to the door ice maker 253 by the door duct 16, and a part of the cold air may be supplied into the ice maker 40 by the distribution duct 60 and the ice maker cover 50. In this manner, ice making is performed. The remaining part of the cold air may be discharged to the space in front of the ice maker assembly 30 through the space between the ice maker 40 and the upper surface of the freezing compartment 12 without passing through the inside of the ice maker 40.

Therefore, it is possible to evenly supply cold air to the entire inside of the freezing compartment 12 and to maintain the entire cooling performance of the freezing compartment 12 while maintaining the ice making performance. In particular, cold air may also be supplied to the upper space of the freezing compartment 12 covered by the ice maker assembly 30, that is, the space between the ice maker assembly 30 and the freezing compartment door 21.

Therefore, it is possible to ensure uniform cold air circulation and uniform temperature distribution throughout the freezing compartment 12.

As such, in a state in which the ice maker 40 and the door ice maker 253 are disposed to face each other in the space at the upper end of the freezing compartment 12, cold air may be supplied through the three passages. That is, even in a state in which the ice maker assembly 30 and the door ice maker assembly 25 are densely disposed in a narrow space above the freezing compartment 12, cold air may be supplied to ensure the ice making performance of each of the ice maker 40 and the door ice maker 253, and cold air may be supplied and circulated so that cold air circulation and uniform temperature distribution in the dense upper space of the freezing compartment 12 are possible.

In addition, cold air passing through the upper surface of the ice maker 40 is discharged into the freezing compartment 12 through the lower discharge passage 318 and the lower discharge port 317, and the ice tray 45 is indirectly cooled to delay the ice making time. Ice may be made transparent inside the cell C. Cold air passing through the lower discharge passage 318 is insulated by the cover heat insulating material 32 to minimize the transfer of cold air to the front cover 31.

A part of cold air discharged to the front of the front cover 31 through the cover passage 530 may flow downward along the front surface of the front cover 31 through the front discharge port 315. Therefore, it is possible to prevent the formation of condensation or frost on the front surface of the front cover 31 and to remove the already formed condensation or frost.

According to an implementation of the present disclosure, cold air for ice making may be smoothly supplied to the ice maker disposed inside the freezing compartment, the inside of the freezing compartment may be cooled through the cover passage bypassing the ice maker, and cold air may be evenly supplied to the entire inside of the freezing compartment.

In addition, even in the structure in which the ice maker is disposed to cover the cold air discharge port, cold air may be bypassed to the space in front of the ice maker through the cover passage by the ice maker cover. Therefore, cold air may be supplied to the entire region of the freezing compartment, and the inside of the freezing compartment has a uniform temperature distribution.

In some implementations, cold air supplied to the ice maker can have a passage that passes through the upper surface of the ice maker case and is discharged to the freezing compartment through the case outlet, the lower flow passage, and the lower discharge port. Therefore, most of cold air supplied to the ice maker does not intensively cool the cell portion of the ice tray, and cools the periphery evenly so that ice may be made gradually. Therefore, the ice to be made may be made transparent, thereby improving ice making quality and ice making performance.

In addition, when cold air passing through the ice maker is discharged through the lower discharge passage, cold air may block cold air transferred to the front cover may be blocked by the cover heat insulating material. Therefore, there is an effect that may prevent the occurrence of condensation or frost when moisture introduced when the freezing compartment door is opened or closed contacts the front cover.

Even if condensation or frost partially occurs on the front surface of the front cover, a part of cold air discharged to the front through the cover passage may be branched and discharged downward through the front discharge port. Therefore, it is possible to remove condensation or frost generated on the front cover by cold air discharged downward from the front discharge port and passing through the front surface of the front cover.

That is, even if condensation or frost is generated on the surface of the front cover due to the opening and closing of the freezing compartment door or the defrosting operation, it is possible to remove condensation or frost generated on the front cover by cold air discharged downward through the front discharge port.

When the door ice maker is provided in front of the ice maker, that is, on the rear of the door, the space between the ice maker and the door ice maker is close, and thus the supply of cold air may not be smooth. Cold air that bypasses the ice maker and is discharged forward due to the cover passage may be supplied to the space between the ice maker and the door ice maker to enable cold air circulation in a narrow space.

Since cold air discharged from the rear side of the freezing compartment is branched into three passages in the upper portion of the freezing compartment and supplied to the door ice maker, the ice maker, and the freezing compartment space between the door ice maker and the ice maker, cold air may be effectively distributed and supplied in the densely arranged upper space of the freezing compartment to secure ice making performance and enable uniform temperature distribution in the narrow upper space of the freezing compartment.

The above description is merely illustrative of the technical idea of the present disclosure, and various modifications and changes may be made thereto by those skilled in the art without departing from the essential characteristics of the present disclosure.

Therefore, the implementations of the present disclosure are not intended to limit the technical spirit of the present disclosure but to describe the technical idea of the present disclosure, and the technical spirit of the present disclosure is not limited by these implementations.

The scope of protection of the present disclosure should be interpreted by the appending claims, and all technical ideas within the scope of equivalents should be construed as falling within the scope of the present disclosure.

What is claimed is:

1. A refrigerator comprising:

a cabinet defining a storage space therein;

a door configured to open and close at least a portion of the storage space; and an ice maker assembly provided in the storage space, wherein the ice maker assembly comprises:

an ice maker provided forward of a cold air discharge port that is provided at a rear portion of the storage space, the cold air discharge port being configured to deliver cold air, a front cover that covers a front side of the ice maker and that is configured to be exposed to an outside of the cabinet based on the door being opened, and an ice maker case defining an outer appearance of the ice maker, wherein a discharge passage is defined between a rear surface of the front cover and a front surface of the ice maker case, the discharge passage being configured to guide cold air from an upper side of the ice maker toward a lower side of the ice maker.

2. The refrigerator of claim 1, wherein the cold air discharge port is provided at an upper end of a rear surface of the storage space.

3. The refrigerator of claim 2, wherein the ice maker covers a front side of the cold air discharge port.

4. The refrigerator of claim 1, wherein the ice maker assembly comprises an ice maker cover that covers an upper side of the ice maker, and wherein a cover passage is defined in the ice maker cover, the cover passage being configured to guide the cold air discharged from the cold air discharge port to bypass the ice maker and flow toward a front of the front cover.

5. The refrigerator of claim 4, wherein the ice maker cover comprises a cover body that covers an upper surface of the ice maker, and wherein a lower surface of the cover body is opened to define a space in which the upper surface of the ice maker is accommodated.

6. The refrigerator of claim 5, wherein a sidewall extending upward to contact an upper surface of the storage space to thereby define the cover passage between the cover body and the upper surface of the storage space is disposed at an upper surface of the cover body.

7. The refrigerator of claim 4, wherein the front cover defines a cover discharge port that is in fluid communication with the cover passage and is opened toward a front of the storage space.

8. The refrigerator of claim 7, wherein the cover discharge port is defined by recessing an upper end of the front cover upward and is spaced apart from an upper surface of the storage space based on the front cover being mounted.

9. The refrigerator of claim 7, wherein a front discharge port which passes through a front surface of the front cover and through which cold air supplied from the cover passage is discharged is defined below the cover discharge port.

10. The refrigerator of claim 9, wherein a discharge port guide partitioning the cover discharge port and the front discharge port is disposed between the cover discharge port and the front discharge port.

11. The refrigerator of claim 10, wherein the discharge port guide comprises:

a first guide defining a lower end of the cover discharge port and configured to guide in a forward direction the cold air flowing from the cover passage; and a second guide extending downward from a front end of the first guide and configured to guide below the front discharge port the cold air flowing from the cover passage.

12. The refrigerator of claim 11, wherein the first guide has an inclination that decreases toward the forward direction, and wherein a rear end of the first guide is located higher than a front end of the cover passage.

13. The refrigerator of claim 11, wherein the second guide protrudes more than a front surface of the front cover, and wherein the front discharge port is provided in a spaced apart manner between a lower end of the first guide and a front surface of the front cover.

14. The refrigerator of claim 9, wherein the ice maker assembly further comprises a heat insulating material provided at a rear surface of the front cover and configured to at least partially block the cold air passing through the ice maker from being delivered past a front surface of the front cover, and wherein the front cover comprises:

a front portion defining a front appearance and covering the ice maker; and an edge portion extending rearward along a circumference of the front portion, wherein the heat insulating material is made of a foam material and is provided at an inner space defined by the edge portion.

15. The refrigerator of claim 14, wherein a heat insulating material cutout portion is defined at an upper end of the heat insulating material to thereby reduce interference between (i) the heat insulating material and (ii) the cover discharge port and the front discharge port.

16. The refrigerator of claim 4, wherein a distribution duct that branches the cold air discharged from the cold air discharge port to the ice maker cover and an inside of the ice maker is provided between the cold air discharge port and the cover passage.

17. The refrigerator of claim 1, wherein the ice maker further comprises an ice tray mounted inside the ice maker case and defining a plurality of cells configured to make ice therein, and wherein the ice maker case comprises a case upper surface defining an upper surface and a case circumferential surface extending downward along a circumference of the case upper surface and defining a downwardly opened space.

18. The refrigerator of claim 17, wherein a rear end of the case upper surface defines a case inlet that is in fluid communication with the cold air discharge port to thereby allow cold air to flow into the ice maker, wherein a front end of the case upper surface defines a case outlet through which cold air flowing into the case inlet is discharged, and wherein the plurality of cells are disposed between the case inlet and the case outlet.

19. The refrigerator of claim 18, wherein the discharge passage is in fluid communication with the case outlet.

20. The refrigerator of claim 1, wherein the ice maker assembly further comprises a heat insulating material provided at a rear surface of the front cover and configured to at least partially block the cold air passing through the ice maker from being delivered past a front surface of the front cover.

* * * * *